US012172825B2

(12) United States Patent
Abels et al.

(10) Patent No.: US 12,172,825 B2
(45) Date of Patent: Dec. 24, 2024

(54) CLOSURE ASSEMBLY FOR USE WITH A CONTAINER

(71) Applicant: Four Strong IP LLC, Pittsboro, NC (US)

(72) Inventors: David Abels, Pittsboro, NC (US); Joshua Boggs, Aledo, TX (US); Todd L. Smith, Hillsboro, OR (US); Isaac Chang, Placentia, CA (US); Mark Harburg, Detroit, MI (US)

(73) Assignee: Four Strong IP LLC, Pittsboro, NC (US)

( * ) Notice: Subject to any disclaimer, the term of this patent is extended or adjusted under 35 U.S.C. 154(b) by 144 days.

(21) Appl. No.: 17/958,708

(22) Filed: Oct. 3, 2022

(65) Prior Publication Data

US 2023/0079062 A1 Mar. 16, 2023

Related U.S. Application Data

(63) Continuation of application No. 16/919,190, filed on Jul. 2, 2020, now Pat. No. 11,485,570, which is a (Continued)

(51) Int. Cl.
*B65D 83/40* (2006.01)
*B65D 41/08* (2006.01)

(52) U.S. Cl.
CPC ..... *B65D 83/40* (2013.01); *B65D 41/083* (2013.01)

(58) Field of Classification Search
CPC ..... B65D 83/40; B65D 41/083; B65D 83/757
(Continued)

(56) References Cited

U.S. PATENT DOCUMENTS 3,049,263 A 8/1962 Edelstone et al.
3,162,329 A 12/1964 Gregory
(Continued)

FOREIGN PATENT DOCUMENTS

CN 208054079 11/2018
DE 102005056746 5/2007
(Continued)

OTHER PUBLICATIONS

International Search Report and Written Opinion for Application No. PCT/US2021/014406 dated Apr. 1, 2021 (17 pages).
(Continued)

*Primary Examiner* — Vishal Pancholi
(74) *Attorney, Agent, or Firm* — E. Eric Mills; Nicholas P. Stadnyk; Maynard Nexsen PC

(57) ABSTRACT

The presently disclosed subject matter is directed to a closure assembly for use with a container (e.g., an aerosol can). The closure assembly includes a skirt and a protective cap. In some embodiments, a lock feature temporarily attaches the protective cap to the container and increases a force required for a user to remove the protective cap. In some embodiments, an inner lock opening of the skirt is configured to be registered with an outer lock opening to receive a locking element therethrough. In some embodiments, a set screw is positioned in the skirt to selectively allow or inhibit relative rotation between the skirt and the protective cap. In some embodiments, a biasing element selectively allows or inhibits engagement of threads of the protective cap with the threads of the skirt depending upon application of an axial force to overcome a biasing force of the biasing element.

16 Claims, 49 Drawing Sheets

Related U.S. Application Data continuation of application No. 16/751,170, filed on Jan. 23, 2020, now Pat. No. 10,737,875.

(58) Field of Classification Search
USPC ..... 222/182, 153, 402.11
See application file for complete search history.

(56) References Cited

U.S. PATENT DOCUMENTS

| | | | |
|---|---|---|---|
| 3,245,588 | A | 4/1966 | Sagarin |
| 3,352,249 | A | 11/1967 | Franz |
| 3,438,537 | A | 4/1969 | Hendrickson |
| 3,439,830 | A | 4/1969 | Hendrickson |
| 3,462,045 | A | 8/1969 | Markowitz |
| 3,655,100 | A | 4/1972 | Markowitz |
| 3,690,519 | A | 9/1972 | Wassilieff |
| 3,802,607 | A | 4/1974 | Mead |
| 3,870,187 | A | 3/1975 | Bennett |
| 3,926,327 | A | 12/1975 | Schickedanz |
| 4,135,638 | A | 1/1979 | Wandl |
| 4,353,483 | A | 10/1982 | Pehr |
| 4,576,315 | A | 3/1986 | Vitale |
| 4,821,913 | A | 4/1989 | Hidding |
| 5,520,305 | A | 5/1996 | Pierson |
| 6,769,563 | B2 | 8/2004 | Tumlin et al. |
| 7,017,785 | B2 | 3/2006 | Lasserre et al. |
| 8,360,281 | B2 | 1/2013 | DeJonge |
| 8,584,903 | B2 | 11/2013 | DeJonge |
| 8,616,420 | B2 | 12/2013 | Schriner |
| 9,932,139 | B2 | 4/2018 | Scott et al. |
| 10,239,673 | B1 | 3/2019 | DeJonge |
| 2003/0102278 | A1 | 6/2003 | Chupak |
| 2004/0026454 | A1 | 2/2004 | Meshberg |
| 2006/0237481 | A1 | 10/2006 | Ho |
| 2006/0273111 | A1 | 12/2006 | Heatley et al. |
| 2010/0206908 | A1 | 8/2010 | Pruvot |
| 2013/0214004 | A1 | 8/2013 | Dejonge |
| 2015/0048112 | A1 | 2/2015 | Skillin et al. |
| 2015/0166250 | A1 | 6/2015 | Brace et al. |

FOREIGN PATENT DOCUMENTS

| | | |
|---|---|---|
| GB | 2044735 | 10/1980 |
| JP | 2001294285 | 10/2001 |
| WO | 1997010155 | 3/1997 |

OTHER PUBLICATIONS

International Preliminary Report on Patentability for Application No. PCT/US2021/014406 dated Mar. 10, 2022 (23 pages).

CLOSURE ASSEMBLY FOR USE WITH A CONTAINER

CROSS REFERENCE TO RELATED APPLICATIONS

The present application claims priority to U.S. patent application Ser. No. 16/919,190, filed Jul. 2, 2020, which is a continuation of U.S. patent application Ser. No. 16/751,170, filed Jan. 23, 2020, now U.S. Pat. No. 10,737,875, issued Aug. 11, 2020, all of which are hereby incorporated by reference in their entirety.

TECHNICAL FIELD

The presently disclosed subject matter relates to a closure assembly for use with a container, such as an aerosol can.

BACKGROUND

Conventional protective caps for containers (e.g., aerosol spray paint canisters) are generally configured to press-fit against an upper surface of the container to cover a dispensing valve. To release the contents of the container in a controlled manner, it is necessary to remove the cap to access the dispensing mechanism, such as an aerosol spray button. Generally, the cap is removed by gripping opposing side surfaces and pulling in an upward direction, away from the container base. Alternatively, removal of the cap can be accomplished through the user of a tool, such as a screwdriver. However, removal and attachment of conventional protective caps can be especially difficult and/or painful for various consumers, such as individuals that have limited grip strength or joint pain. Further, the difficulty in removing and/or replacing protective caps is repeated upon each subsequent dispensing of the container contents. It would therefore be beneficial to provide a cap assembly that overcomes the deficiencies of the prior art. In an effort to prevent accidental cap loss or misplacement and to discourage consumer testing of the container contents prior to purchase, it would also be beneficial if the cap assembly includes one or more protective features, such as a lock.

SUMMARY

In some embodiments, the presently disclosed subject matter is directed to a closure assembly for use with a container. Particularly, the closure assembly comprises a skirt configured to attach proximately to a first end of the container. The skirt is defined by a first coupler and a central opening sized and shaped to fit around at least a portion of the first end of the container. The assembly includes a cap comprising an interior sized and shaped to house a container dispenser, and a second coupler that releasably attaches and detaches with the first coupler. The assembly includes an optional lock that inhibits the detachment of the first and second couplers, wherein when the first and second couplers detach, the cap can be removed from the container; and wherein the first and second couplers attach, the cap is releasably attached to the container.

In some embodiments, the container is an aerosol can.

In some embodiments, the first coupler comprises external helical threads and the second coupler comprise internal helical threads.

In some embodiments, the assembly further comprises the container.

In some embodiments, the lock is defined as a frangible material attached to at least a portion of the cap and the skirt, wherein the frangible material inhibits the detachment of the first and second couplers prior to rupture of the frangible material. In some embodiments, the frangible material is selected from a heat shrink material, an adhesive, a circumferentially extending tab, a perforated joint, or combinations thereof.

In some embodiments, the lock is defined as one or more rupturable tabs configured within the interior of the cap that attach the cap to the skirt or the container; wherein at least one surface of the cap comprises one or more removable portions that allow access to the one or more tabs when removed, wherein the rupturable tabs inhibit the detachment of the first and second couplers prior to removal of the tabs. In some embodiments, each removable portion is vertically or horizontally aligned with one or more tabs.

In some embodiments, the lock is defined as one or more removable tabs positioned at a joint where the first and second couplers join, wherein the one or more removable tabs inhibit detachment of the first and second couplers prior to removal of the tabs from the joint. In some embodiments, the removable tabs each join with a groove in a sidewall of the skirt, wherein a connection between the removable tabs and the grooves inhibit detachment of the first and second couplers prior to removal of the tabs from the grooves. The term "groove" as used herein refers to any cut, indentation, channel, furrow, or depression that can be used to guide or receive a corresponding tab.

In some embodiments, the removable tabs comprise hinges that allow the tabs to attach and detach from the grooves. The term "hinge" as used herein refers to a mechanical bearing that connects two elements to allow an angle of rotation between the two elements.

In some embodiments, the lock is defined as an inner cap housed within the cap interior, wherein the inner cap comprises an interior that houses a container dispenser, and the inner cap releasably attaches to a portion of the container housed within the cap interior. In some embodiments, the inner cap includes a removal element selected from a frangible seal, pull tab, tear strip, shrink wrap material, or combinations thereof. In some embodiments, the inner cap releasably connects with the skirt.

In some embodiments, the lock is defined by a removable tamper resistant ring. The term "tamper resistant" refers to packaging that readily displays or allows for an individual to observe or prevent any physical interference or manipulation of the packaging. In some embodiments, the tamper resistant ring is releasably attached to a top surface of the skirt and to a bottom surface of the cap, wherein when the tamper resistant ring is attached to the skirt and cap, the first and second couplers cannot attach together, but when the tamper resistant ring is removed from the skirt and cap, the first and second couplers can removably attach and detach together. In some embodiments, the tamper resistant ring comprises a pull tab, frangible portion, perforated area or combinations thereof. In some embodiments, the tamper resistant ring releasably attaches to the container and a bottom surface of the cap, wherein when the tamper resistant ring is attached to the cap and container, the first and second couplers cannot detach, and when the tamper resistant ring is removed, the first and second couplers can attach and detach.

In some embodiments, the lock is defined as one or more removable bands that extend from a portion of the cap to an opposing end of the container, wherein the bands must be removed to allow the first and second couplers to detach. In some embodiments, the bands can be removed from the cap or container via one or more tabs positioned on one or more bands.

In some embodiments, the lock is defined by a mechanical closure positioned in the skirt, wherein when the mechanical closure is not activated, the first and second couplers cannot detach from each other and the cap and skirt are configured to freely rotate around the container, and wherein the mechanical closure is activated, the first and second couplers can attach and detach. In some embodiments, the mechanical closure is selected from a screw, clip, nail, bolt, pin, or combinations thereof.

In some embodiments, the lock is defined as a gripper that releasably attaches the cap to the container, wherein the cap includes a flexible sidewall portion that is deformed by applied pressure to displace the gripper, thereby allowing the first and second couplers to detach.

In some embodiments, the lock is defined as a first opening positioned on the cap and a second opening positioned on the skirt, wherein the first and second openings are aligned and a removable tie passes through the first and second openings; wherein removal of the tie allows the first and second couplers to detach.

In some embodiments, the lock is defined as a removable element positioned within the cap or skirt that inhibits detachment of the first and second couplers, wherein when the removable element is removed the first and second couples are detachable. In some embodiments, the removable element is a thread mismatch segment.

In some embodiments, the lock is defined as a twist knob that extends through a portion of the cap, wherein activation of the twist knob allows detachment of the first and second couplers. In some embodiments, activation of the twist knob ruptures one or more frangible tabs positioned between a surface of the twist knob and an interior cap surface.

In some embodiments, activation of the twist knob ruptures a portion of material that spans the cap interior and is configured under the container dispenser.

In some embodiments, the cap interior comprises a compartment housing at least a portion of the container dispenser.

In some embodiments, the cap interior comprises a ring that extends around the container dispenser, wherein the ring includes a top removable portion and a bottom portion. The top removable portion has a height that extends above a height of the container dispenser; and wherein the bottom portion has a height that extends below at least a portion of the height of the container dispenser.

In some embodiments, the lock is defined by one or more arms angled away from the container, wherein each arm includes a ridge that extends through an aperture in the cap, wherein each arm can be repositioned to displace the ridge from the cap aperture to allow the first and second couplers can detach.

In some embodiments, the assembly comprises a bag that houses at least a portion of the container, wherein the container is accessed by opening the bag. In some embodiments, the bag houses the container dispenser or the entire container.

In some embodiments, the cap comprises a push down lock configure to open by simultaneously pushing down and twisting a top surface of the cap.

In some embodiments, an elastomeric material is attached to an inner surface of the cap and wrapped around at least a portion of the container dispenser, wherein the elastomeric material is accessed after the cap is removed from the container.

In some embodiments, the lock is defined as a rotatable knob that extends through one face of the cap, wherein the knob is operably connected to a central ring that extends about a portion of the container, wherein activating the knob ruptures the central ring, allowing the first and second couplers to detach.

In some embodiments, the lock is defined as a frangible area positioned on one surface of the cap, wherein the frangible area includes an arm operably connected to the container dispenser, wherein removal of the frangible portion and arm allows the first and second couplers to detach.

In some embodiments, the cap comprises inner and outer rings that rotate relative to each other, wherein each ring includes one or more notches that align to allow the first and second couplers to detach.

In some embodiments, the presently disclosed subject matter is directed to a method of accessing the dispensing mechanism of a container comprising a first end and an opposed second end. Particularly, the method comprises attaching a skirt proximate to the first end of the container, wherein the skirt comprises an attachment configured to be permanently secured to a container; a connector operably joined to the attachment, the connector comprising a first coupler; and a central opening sized and shaped to fit over the container dispensing mechanism. The method includes releasably joining a protective cap to the skirt, wherein the protective cap comprises a top wall operably connected to a cap sidewall to create an interior, wherein the cap sidewall comprises a second coupler configured to releasably join with the first coupler, wherein the protective cap interior houses the container dispensing mechanism. The method includes accessing the dispensing mechanism by detaching the first coupler from the second coupler and removing the protective cap.

In some embodiments, the presently disclosed subject matter is directed to a kit for retrofitting a closure assembly to a container comprising a first end that includes a dispensing mechanism, and an opposed second end. The kit comprises a skirt configured to permanently attach proximate to the first end of the container. The skirt includes an attachment configured to permanently secure to a container; a connector operably joined to the attachment, the connector comprising a first coupler; and a central opening sized and shaped to fit over the container dispensing mechanism. The kit comprises a protective cap comprising a top wall operably connected to a cap sidewall to create an interior, wherein the cap sidewall comprises a second coupler configured to releasably attach with the first coupler; wherein the protective cap interior is configured to house the container dispensing mechanism.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary and are intended to provide an overview or framework to understanding the nature and character of the claims. The accompanying drawings are included to provide a further understanding and are incorporated in and constitute a part of this specification. The drawings illustrate one or more embodiment(s), and together with the description serve to explain principles and operation of the various embodiments.

DETAILED DESCRIPTION

Figure 1A:
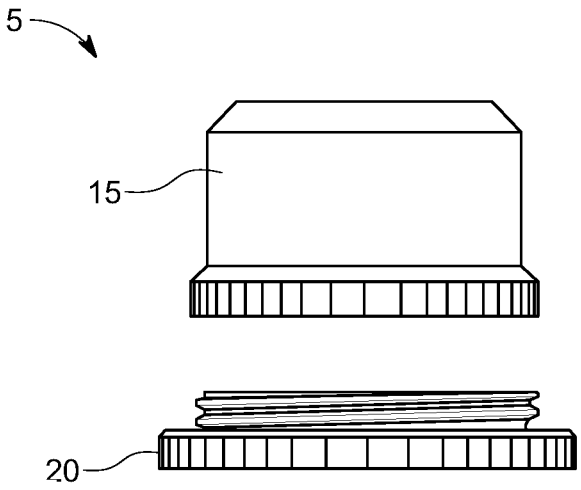
FIG. 1*a* is a front plan view of a closure assembly in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a container" can include a plurality of such containers, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
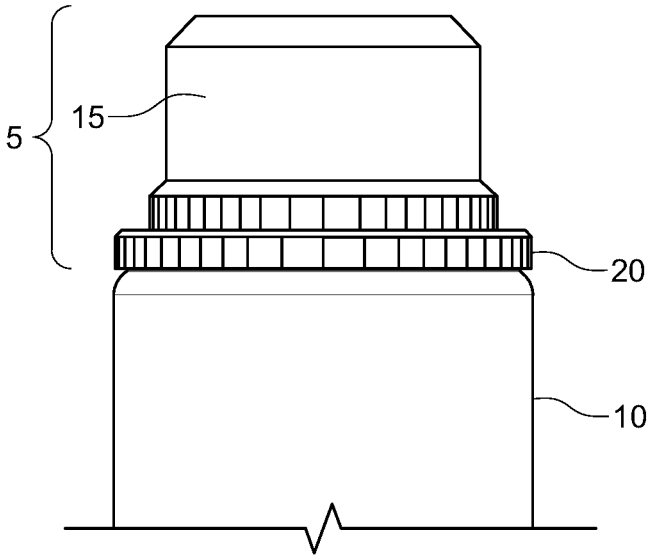
FIG. 1*b* is a front plan view of the closure assembly of FIG. 1*a* installed on a conventional container in accordance with some embodiments of the presently disclosed subject matter.

The presently disclosed subject matter is generally directed to a closure assembly for use with a container. The term "closure assembly" as used herein refers to one or more components that can be used to prevent or allow dispensing of the container contents on demand. As illustrated in FIGS. 1*a* and 1*b*, closure assembly 5 is configured to be used with container 10. It should be appreciated that the disclosed closure assembly can be used with any of a wide variety of containers known and used in the art. As shown, closure assembly 5 comprises protective cap 15 and skirt 20 that are releasably coupled together. The skirt is attached to corresponding container 10, while the protective cap is releasably attached to the skirt (e.g., through the use of external and internal threads). As set forth in more detail herein below, the closure assembly protects and allows access to a container dispensing mechanism by a wide variety of users, including those with joint pain or other difficulties.

Figure 2:
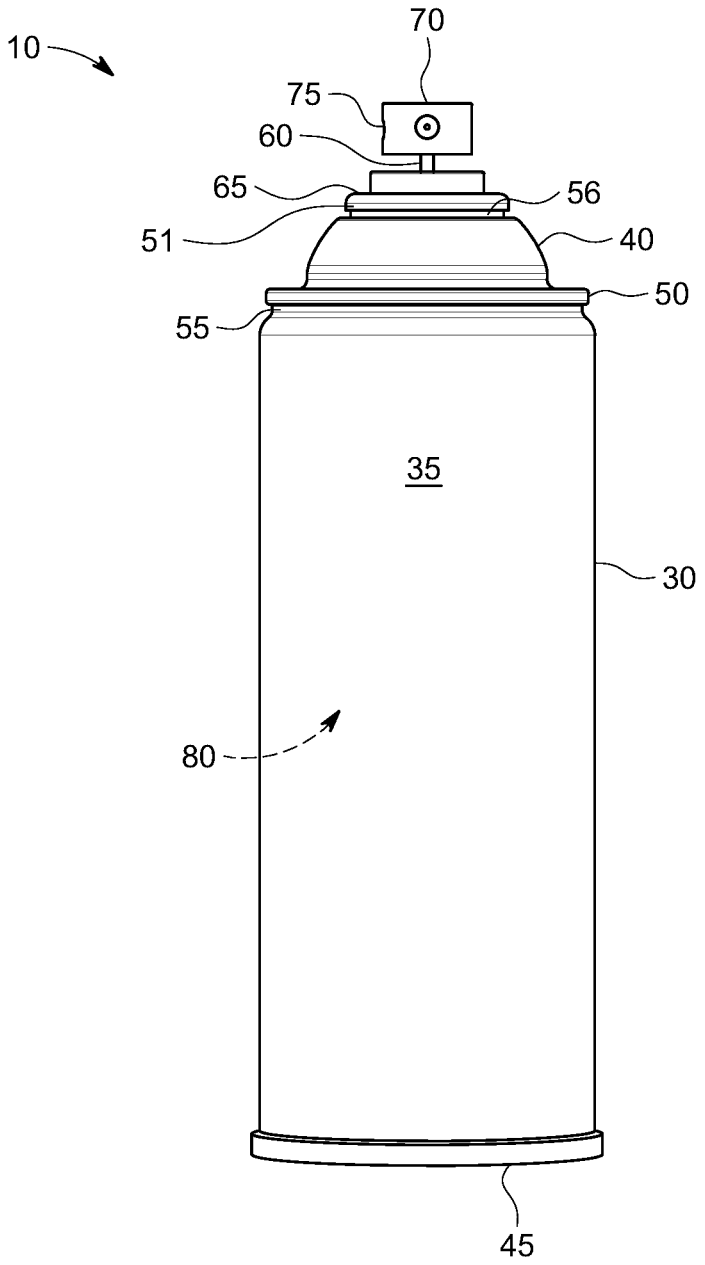
FIG. 2 is a perspective view of a conventional aerosol can in accordance with some embodiments of the presently disclosed subject matter.

FIG. 2 illustrates one embodiment of a conventional container configured as an aerosol can, such as (but not limited to) a spray paint can. As shown, container 10 comprises main body 30 defined by cylindrical sidewall 35. The main body further includes tapered top 40 and bottom wall 45 positioned above and below the sidewall, respectively. The tapered top can be joined to sidewall 35 at first joint 50, which can be configured as a crimp that surrounds the upper circumference of the sidewall. In some embodiments, first recess 55 can be defined between sidewall 35 and first joint 50.

Container 10 further includes a valve assembly comprising valve stem 60 mounted to and extending from valve cup 65. The valve cup is joined to the top surface of tapered top 40 at second joint 51 which in some embodiments can be a crimp. In some embodiments, second recess 56 is defined between tapered top 40 and the second joint. Actuator 70 is attached to the valve stem and includes nozzle 75 through which pressurized contents 80 can be dispensed (e.g., sprayed). Thus, the pressurized contents flow from the interior of main body 30, through valve stem 60 via tubing or any other standard method. The actuator functions to eject pressurized contents 80 from the container interior via nozzle 75. In some embodiments, actuator 70 is upwardly or downwardly biased.

It should be appreciated that the disclosed closure assembly is not limited to an aerosol can and can be used with a variety of pressurized and non-pressurized containers. Thus, the term "container" as used herein refers broadly to any vessel configured to house a product volume, such as (but not limited to) cans, bottles, boxes, tubes, pouches, etc. made from metal, glass, plastic, cardboard, and the like suitable for pressurized filling with one or more products, or filling at ambient pressure. In some embodiments, the container can include a dispenser configured to dispense product from a container. Any known dispenser can be used, including (but not limited to) a spray nozzle, pump, trigger-actuated sprayer, or any other know dispensing element.

Contents 80 are not limited and can include any material capable of being dispensed from a container, such as (but not limited to) spraying from an aerosol can. Thus, in some embodiments, contents 80 can include (but are not limited to) paint, cleaning product (e.g., window cleaner, oven cleaner, furniture polish), chemicals, insecticide, insect repellent, lubricant, sealant, herbicide, foam, deodorizer (e.g., air purifier, air disinfectant, air freshener), personal care product (e.g., deodorant, hair spray, sunscreen, cologne, perfume), edible product (e.g., whipped cream, olive oil), and the like. Contents 80 can comprise a fluid. The term "fluid" refers to a substance that is capable of flowing, including particulate solids, foams, liquids, and gases.

Figure 3A:
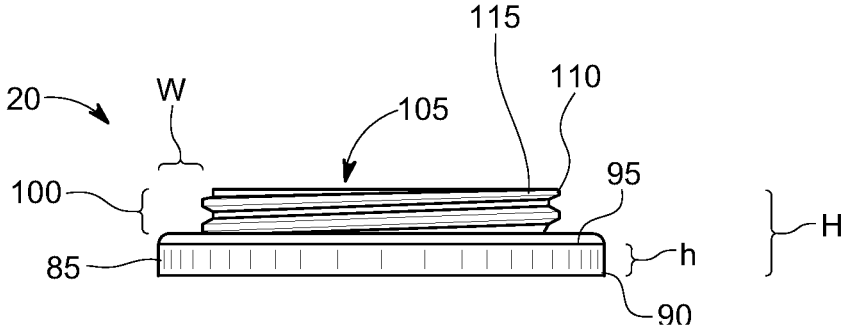
FIG. 3*a* is a front plan view of a skirt that can be used in accordance with some embodiments of the presently disclosed subject matter.

As set forth above, closure assembly 5 comprises protective cap 15 and skirt 20. One embodiment of skirt 20 configured as a threaded ring is illustrated in FIG. 3*a*. The term "skirt" broadly refers to an element that can be permanently or releasably attached to a container, and allows for connection with a container cap. As shown, the skirt is defined by attachment 85, first coupler 100, and central opening 105. Attachment 85 provides a means by which the skirt is connected to container 10. Therefore, skirt 20 can be permanently or temporarily attached to container 10 via can attachment 85 using any known mechanism, such as (but not limited to) adhesive, welding, epoxy, mechanical closures (screws, pins, clasps, bolts, etc.), press fit connection, snap fit connection, contoured fit connection, and the like.

In some embodiments, container attachment 85 comprises vertical sidewall 90 and horizontal upper surface 95. Vertical sidewall 90 can have any desired height (h) to fit a wide variety of containers, such as at least about (or no more than about) 0.1-10 inches. Thus, the vertical sidewall can have a height of about 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, or 9.5 inches. However, the presently disclosed subject matter is not limited and the vertical sidewall can be configured with a height outside the range set forth above. The term "height" as used herein refers to the vertical distance measure of an object (e.g., how tall an object is).

Similarly, upper surface 95 can have any desired width (w) to fit a variety of containers, such as about (or no more than about) 0.1-10 inches. Thus, upper surface 95 can have a width of about 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, or 10 inches. Again, the presently disclosed subject matter is not limited and the horizontal upper surface can be configured with a width outside the range set forth above. The term "width" refers to the horizontal distance measure of an object (e.g., measure from side to side, such as across an object at right angles to the length).

Further, it should be appreciated that although the terms "vertical" and "horizontal" have been used, sidewall 90 and upper surface 95 can be configured at any desired angle, be curved, and/or have any desired shape.

It should additionally be appreciated that skirt attachment 85 is not limited to the embodiment shown in FIG. 3*a*. Rather, the attachment can include any configuration so long as it allows for coupling with a container.

In some embodiments, first coupler 100 extends upwardly from attachment 85 and releasably attaches with a second coupler configured on cap 15. For example, the first coupler can include a plurality of external threads 110 positioned around central opening 105. The external threads engage with internal threads positioned on the cap interior to provide a releasable attachment. The term "thread" refers to a projecting rib that extends helically along a member. Thus, an "external thread" refers to a thread extending radially outward on an outside of a member (e.g., on the outside of first coupler 100). An "internal thread" refers to a thread extending radially inward on an inside of a member (e.g., on the inside surface of cap 20). The first coupler can comprise any desired number of external threads to accommodate a container of any size.

The term "coupler" as used herein refers broadly to a device or component that joins two or more elements together. The first and second couplers are selectively engaged together using any known mechanism, including (but not limited to) helical threads, zippers, snaps, VELCRO®, clips, buttons, pins, straps, clasps, buckles, hooks, laces, magnets, ties, or any other type of fastener that allows for removable attachment of cap 15 to skirt 20.

Figure 3B:
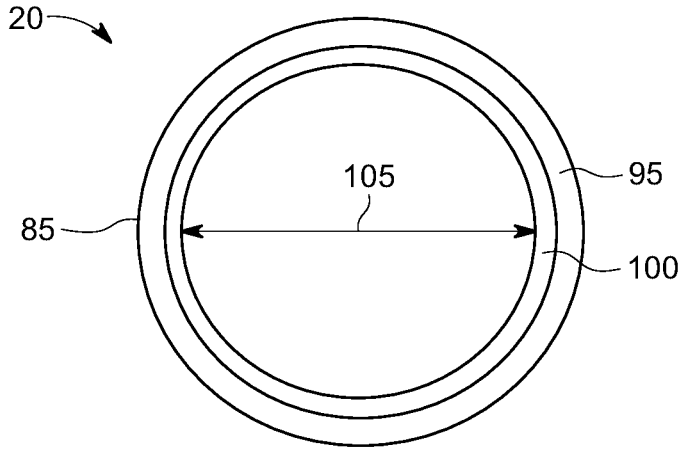
FIG. 3*b* is a top plan view of the skirt of FIG. 3*a*.

The skirt includes central opening 105, as illustrated in FIG. 3*b*. Opening 105 allows the dispensing element of the container (e.g., actuator 70 and nozzle 75) to pass therethrough when the skirt is mounted on container 10 (e.g., at first and/or second joints 55, 56). In some embodiments, opening 105 is configured to be circular in shape, as shown in the Figures. However, the shape of opening 105 is not limited and can be constructed in any desired shape. It should be appreciated that in some embodiments, the shape of opening 105 is the same or about the same as the circumferential shape of one wall of a container (e.g., the tapered wall 40 of an aerosol can) to allow secure connection thereto. Further, the inner circumference of opening 105 is larger or slightly larger than the outer circumference of at least a portion of container 10. Thus, opening 105 can be configured with any desired diameter (such as at least about or no more than about 0.5-10 inches) to accommodate a variety of container sizes. However, the diameter of opening 105 is not limited and can be greater or less than the range given above.

The height (H) of skirt 20 is configured such that top peripheral edge 115 can be positioned beneath the container dispensing element (e.g., nozzle 75) when engaged with the container (e.g., to avoid interfering with operation of the actuator and emission of contents 80 from the nozzle). Skirt 20 can have any desired height, such as about 0.1-5 inches (e.g., about 0.1, 0.2, 0.3, 0.4, 0.5, 0.6, 0.7, 0.8, 0.9, 1, 1.5, 2, 2.5, 3, 3.5, 4, 4.5, or 5 inches). However, the presently disclosed subject matter is not limited and the skirt can have a height larger or smaller than the range given above.

Cap 15 releasably attaches to skirt 20 to cover and protect the container dispensing mechanism (e.g., to prevent dispensing of contents 80 from container 10). The term "cap" as used herein broadly refers to any type of closure for closing a container. Any type of cap known in the art can be utilized with the container. Such caps include (but are not limited to) threaded caps, measuring cups adapted for use as caps, diaphragm valves, ball valves, slit valves, press taps, self-draining spouts, traditional spouts, divided spouts, screw caps, pull caps, snap caps, flip caps, vented caps, and combinations thereof. Thus, cap 15 is capable of sealing, closing, and/or locking the container contents within the container. In some embodiments, the cap is sized and shaped to house a container dispensing assembly. In some embodiments, the cap is child-resistant (e.g., difficult for a child to remove from the container).

Figure 4:
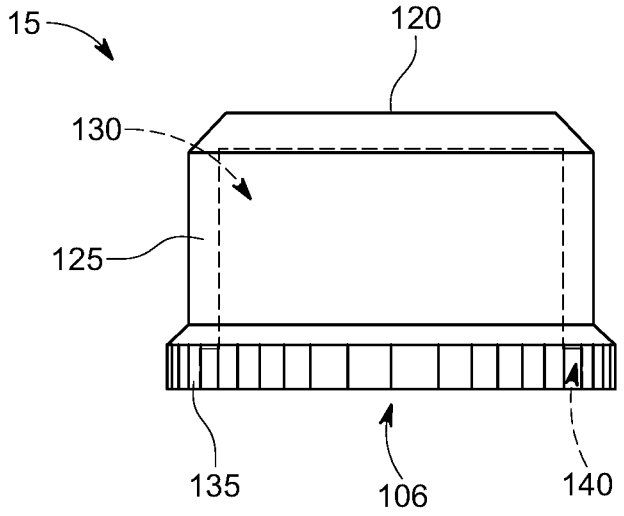
FIG. 4 is a side plan view of a protective cap that can be used in accordance with some embodiments of the presently disclosed subject matter.

As illustrated in FIG. 4, the protective cap includes top wall 120 and sidewall 125 extending downwardly from the top wall to define cap interior 130. In some embodiments, sidewall 125 can be cylindrically shaped, although the shape of the sidewall is not limited. Bottom peripheral edge 135 extends about the lower edge of the cylindrical sidewall and defines cap opening 106. Protective cap 15 includes second coupler 140 (which can be configured as internal threads) proximate to bottom peripheral edge 135. The first and second couplers are configured to removably attach and detach as desired by the user.

For example, cap internal threads can be configured to removably and rotatably engage external threads of skirt 20. However, the first and second couplers are not limited and can include any element that allows for releasable connection with skirt 20.

Skirt 20 and cap 15 can be constructed from any rigid or semi-rigid material. The term "rigid material" refers to a material that resists deformation and is not easily bendable, flexible, and/or malleable. The term "semi-rigid" refers to a material that exhibits an amount of flexibility in that a surface of the material can deform from an original shape without breaking or cracking. Suitable rigid and semi-rigid materials can therefore include (but are not limited to), metal (e.g., stainless steel, aluminum, copper), polymeric material, ceramic, stone, wood, or combinations thereof.

The skirt and cap can be manufactured by a variety of standard methods, including (but not limited to) injection molding, compression molding, machining (e.g., mechanical cutting, laser cutting, etching), extruding, embossing, stamping, casting, and the like.

Figure 5A:
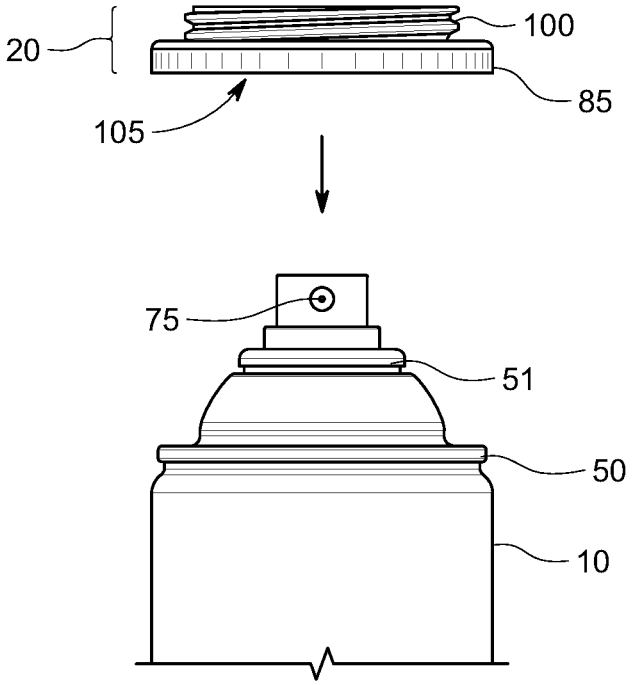
FIGS. 5*a*-5*e* are front plan views of a method of assembling a closure assembly in accordance with some embodiments of the presently disclosed subject matter.
Figure 5B:
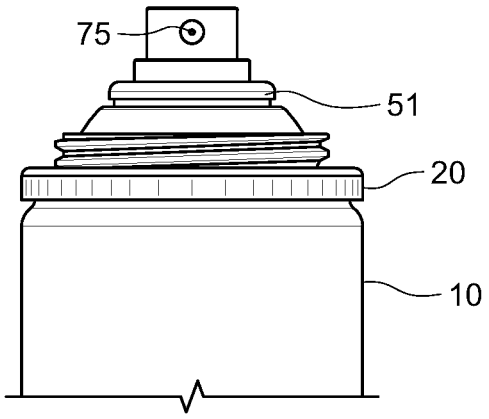
Figure 5C:
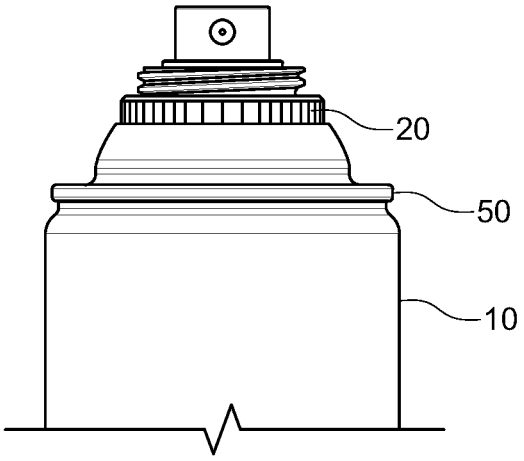

Attachment of the closure assembly to a corresponding container (e.g., container 10) can be easily accomplished. Particularly, skirt opening 105 allows the skirt to pass over nozzle 75, as shown in FIG. 5*a*. The skirt can therefore be attached to container 10 at first joint 50 (as shown in FIG. 5*b*) or second joint 51 (as shown in FIG. 5*c*). However, skirt 20 is not limited to embodiments wherein it must be passed over the top of a container. For example, in some embodiments the skirt can include a movable latch or fastener that opens and closes to allow the skirt to be affixed to a container, such as from the front, rear, or side.

Further, the presently disclosed subject matter is not limited to embodiments wherein the container comprises first and/or second joints. Rather, the skirt can be affixed to or around any container surface, so long as it cooperates with cap 15 to protect or cover a dispensing element.

The skirt can be permanently or releasably attached to container 10 using any known mechanism, such as the use of adhesives, welding, snap fit arrangement, mechanical closures, and the like. In some embodiments, the skirt can be retrofitted onto container 10. In some embodiments, skirt 20 is rotationally fixed relative to the container and cannot move. However, the presently disclosed subject matter also includes embodiments wherein the skirt is rotatable once attached to the container, such that a user can grip a portion of the skirt (e.g., exterior of the first coupler) while also gripping and rotating cap 15 relative to the skirt.

Figure 5D:
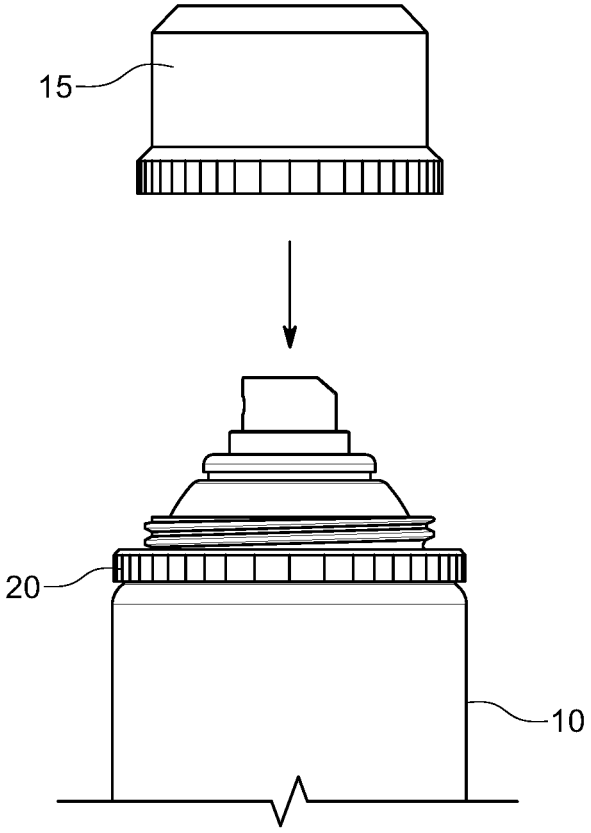
Figure 5E:
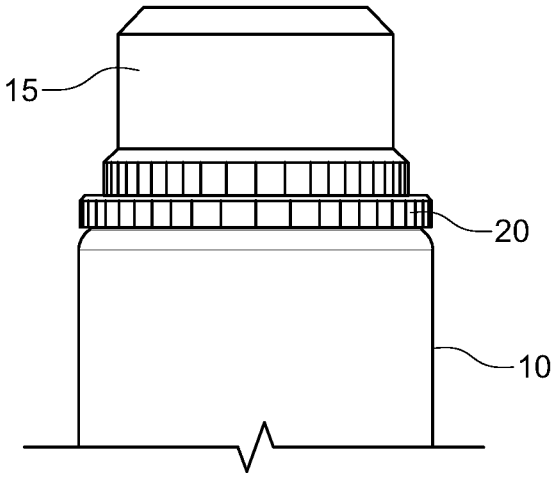

As illustrated in FIGS. 5*d* and 5*e*, cap 15 is then releasably attached to skirt 15. For example, in some embodiments, cap internal threads 140 join with skirt external threads 110 to secure the cap and skirt together. As set forth above, any releasable connection can be used. After attachment of cap 15, the container dispensing assembly (e.g., actuator 70 and nozzle 75) is housed within the cap interior and is protected from the environment, spilling, and the like. In this way, contents 80 cannot be accidentally or prematurely dispensed without removal of the cap.

In use, the closure assembly is positioned on a conventional container as described herein above. For example, in some embodiments, a skirt can be permanently affixed to a first or second joint of a container using adhesive or any other desired method. The cap can then be attached to the skirt to protect the dispensing mechanism of the container, which can include a nozzle and/or actuator. When the user desires to dispense the product housed within the container, the cap is removed from the skirt so a user can access the dispensing mechanism. For example, the cap can be unscrewed from the skirt and removed, thereby exposing the dispensing assembly. The user can dispense product 80 using known methods, such as applying pressure to actuator 70, forcing product through nozzle 75. It should be appreciated that container 10 can include any known dispensing mechanism, such as one or more valves, tubings, flanges, chokes, flow meters, and the like. When the user is done dispensing product, cap 15 is reapplied to the skirt, such as through a threaded connection.

Advantageously, attachment of skirt 20 enables cap 15 to be releasably connected to container 10 (e.g., through the use of internal/external threads) without significant alteration or modification to the container. Further, the closure assembly can be easily retrofitted to a wide variety of conventional containers without modification to the container design or manufacture. Thus, protective cap 15 can repeatedly attach and detach from skirt 20 until all of the container contents have been dispensed. The closure assembly can then be discarded along with the container or removed and used with a new container.

The disclosed closure assembly therefore protects the container contents from being prematurely dispensed (e.g., by children or by accident), while also allowing for easy dispensing by users with limited joint strength or other similar limitations.

Closure assembly 5 can optionally include one or more protective elements that inhibit removal of cap 15. Such protective elements prevent unintentional dispensing (or dispensing by children) yet are relatively easy to use to allow a wide variety of users to dispense product 80 when desired. Any known protective elements can be used, such as one or more movable, removable, frangible, and/or deformable elements.

Figure 6:
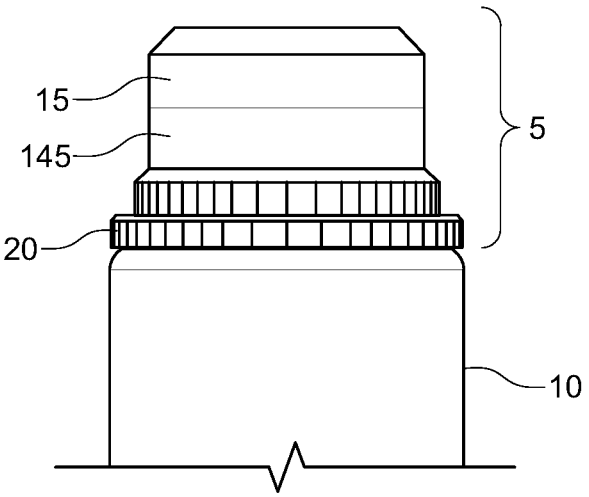
FIG. 6 is a front plan view of a container comprising a closure assembly and a lock feature embodied as a segment of material in accordance with some embodiments of the presently disclosed subject matter.

FIG. 6 illustrates one embodiment of a protective element comprising a portion of material 145 that prevents or resists removal of cap 15. In some embodiments, material 145 can include paper or plastic that has been sized and/or adhered to at least a portion of cap 15, skirt 20, and/or container 10. For example, material 145 can comprise a shrink-wrapped material. The underlying principle is that a mono-axially or biaxially oriented thermoplastic polymeric film is loosely positioned over an article to be protected (e.g., over at least a portion of the cap, skirt, and/or container). When the film is heated above a predetermined temperature, the plastic shrinks as the strain imparted during the orientation process is released. It should be appreciated that any material that can be positioned at least partially over closure assembly 5 can be used. Material 145 must be detached before the cap can be removed from skirt 20, adding an additional layer of protection. For example, the cap can be pulled, pushed, and/or twisted to rupture material 145, thereby separating the protective cap from the skirt. In other embodiments, material 145 can be directly removed using hand pressure, peeling, or an implement (e.g., scissors, screwdriver, knife). In some embodiments, material 145 can include perforations and/or a pull tab to assist with removal. The protective cap can thereafter be removed from the skirt, as discussed above. After dispensing, the cap can be reapplied.

Figure 7A:
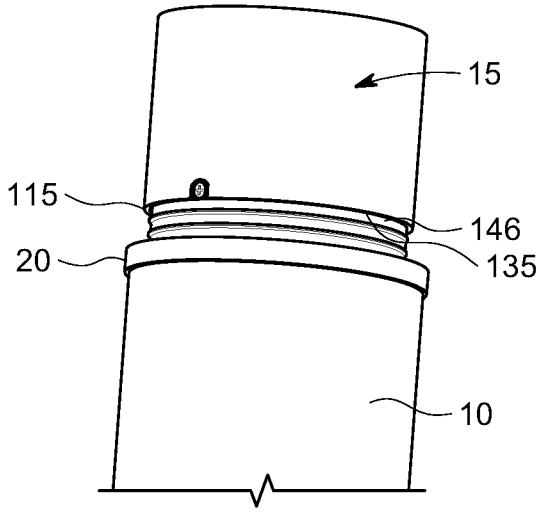
FIG. 7*a* is a perspective view of a closure assembly comprising a lock feature embodied as a frangible attachment between a protective cap and a skirt in accordance with some embodiments of the presently disclosed subject matter.
Figure 7B:
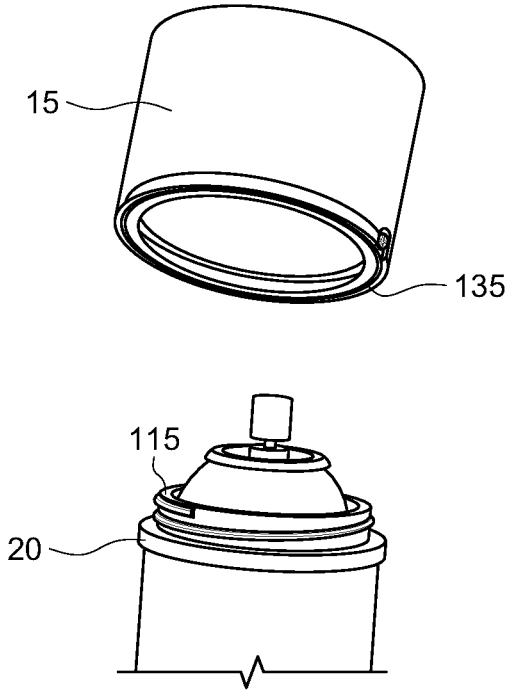
FIG. 7*b* is a perspective view of the closure assembly of FIG. 7*a* with the cap removed.

As set forth in detail below, the disclosed closure assembly can optionally include one or more lock features that inhibit the removal of cap 15, such as by inhibiting the detachment of the first and second couplers. The term "lock" as used herein can broadly refer to an element that fastens together or closes a first item relative to another (e.g., a cap relative to a skirt). FIG. 7*a* illustrates one embodiment of closure assembly 5 comprising a lock feature embodied as frangible attachment 146 between protective cap 15 and skirt 20. The term "frangible" refers to the characteristic of being breakable, and typically refers to a seal that can be compromised by a force or pressure. The frangible attachment is positioned proximate or between top peripheral edge 115 of the skirt and bottom peripheral edge 135 of the protective cap. Thus, the frangible attachment can be attached to the skirt and/or the protective cap. In some embodiments, frangible attachment 146 can be configured as an adhesive (e.g., glue, epoxy, etc.), a frangible bridge, and/or a plurality of frangible tabs. In some embodiments, the frangible attachment integrally attaches the skirt to the protective cap as a one-piece construction. In some embodiments, the frangible attachment can include a joint with perforations and/or a pull tab to assist with separation of the protective cap from the skirt. In some embodiments, the frangible attachment can be broken by use of a removal tool (e.g., screwdriver, knife, pen). Alternatively, applying pressure to cap 15 (e.g., pulling, pushing, twisting) can rupture frangible attachment 146, separating the cap from the skirt. FIG. 7*b* illustrates one embodiment of cap 15 after the frangible attachment has been ruptured and the cap has been removed. After dispensing of a desired amount of container contents, cap 15 can then be reattached to the skirt, such as by rotation relative to skirt threads 110.

Figure 8:
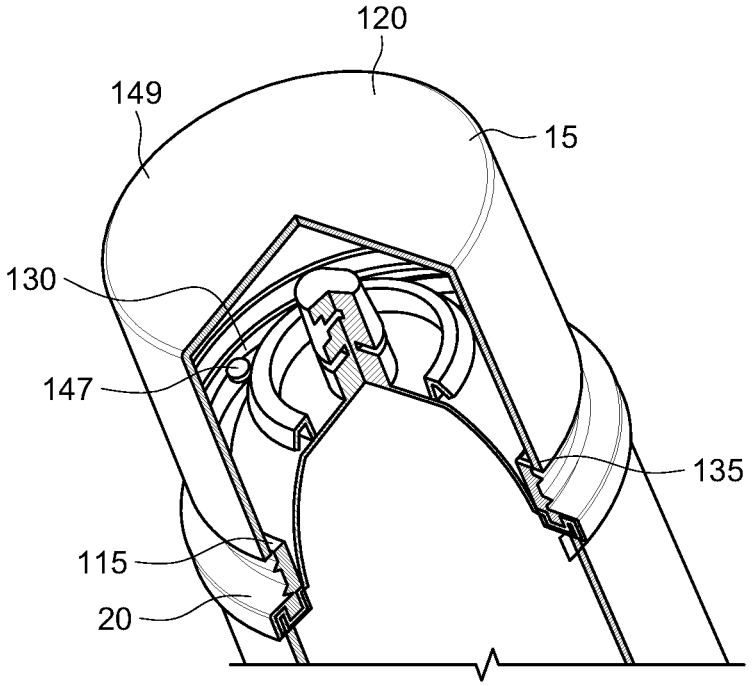
FIG. 8 is a perspective view of a container closure comprising a lock feature embodied as internal tabs of a protective cap in accordance with some embodiments of the presently disclosed subject matter.

FIG. 8 illustrates one embodiment of closure assembly 5 comprising a protective feature configured as one or more internal tabs 147 of protective cap 15. In this embodiment, the internal tabs are positioned proximate or between top peripheral edge 115 of skirt 20 and bottom peripheral edge 135 of the protective cap. Thus, the internal tabs can be attached to skirt 20 and/or protective cap 15 within the cap interior. In some embodiments, internal tabs 147 integrally attach the skirt to the protective cap as a one-piece construction. As shown, the internal tabs are not generally accessible from an exterior of the protective cap. The protective cap can include frangible portion 149 within the top wall. The frangible portion can be generally vertically aligned with at least one internal tab(s) 147. A user can puncture the frangible portion with a tool (e.g., screwdriver, nail, pen cap) to form an opening and thereby provide access to the cap interior. A user can then use the tool to break internal tabs 147, and thereafter separate the protective cap from the skirt. Once the internal tabs are removed, the protective cap can be separated from skirt 20, and reattached as desired (e.g., such as by rotation relative to a skirt).

Figure 9A:
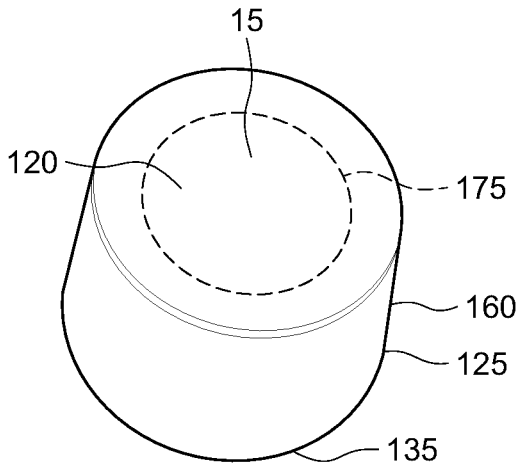
FIG. 9*a* is a top perspective view of a protective cap with a lock feature embodied as a tamper evident outer wall in accordance with some embodiments of the presently disclosed subject matter.
Figure 9B:
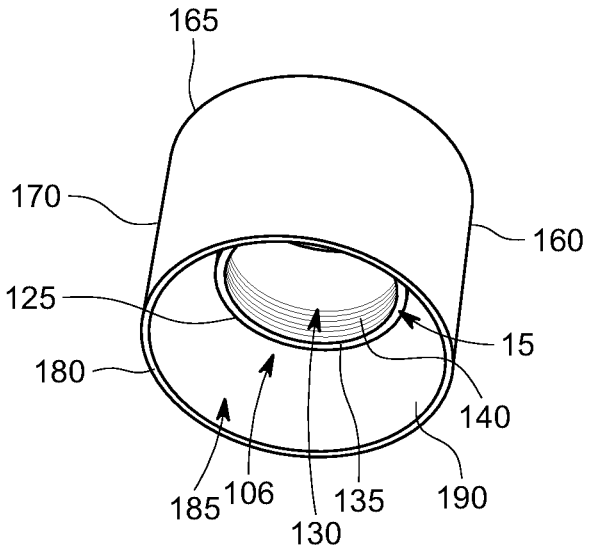
FIG. 9*b* is a bottom perspective view of the cap of FIG. 9*a*.
Figure 9C:
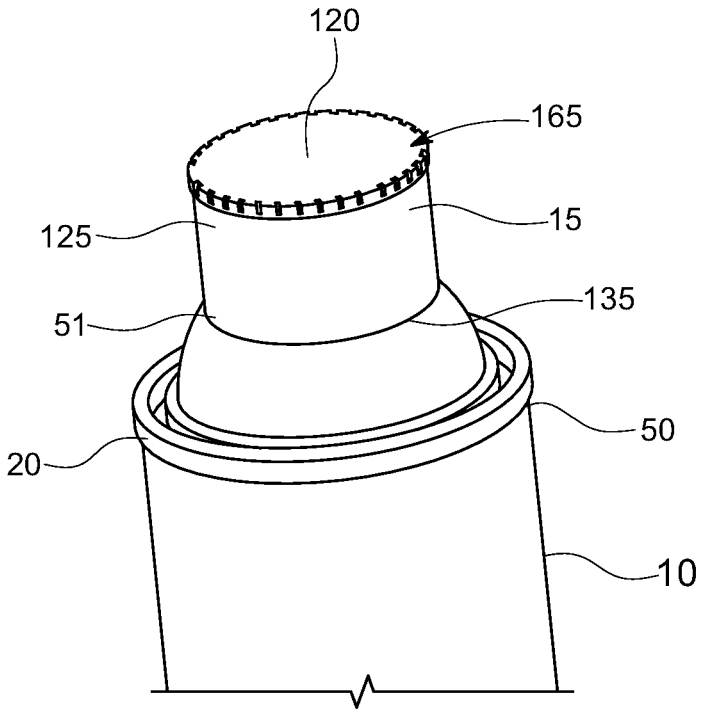
FIG. 9*c* is a perspective view of a container comprising the protective cap of FIG. 9*a*.

FIGS. 9*a*-9*c* illustrate one embodiment of a closure assembly wherein cap 15 includes a lock feature embodied as tamper evident outer wall 160. As shown in FIGS. 9*a* and 9*b*, protective cap 15 can include top wall 120 and a cylindrical sidewall 125 extending downwardly from the top wall to define cap interior 130. Bottom peripheral edge 135 of the cylindrical sidewall defines opening 106. The protective cap includes internal threads 140 proximate to the bottom peripheral edge 135. It should be appreciated that in place of threads 140 the cap can include any desired connection that allows for releasable attachment to skirt 20.

Tamper evident outer wall 160 includes a top wall 165 and a cylindrical sidewall 170 extending downwardly from top wall 165. The top wall of the tamper evident outer wall 160 is connected (e.g., integrally attached) to top wall 148 of the protective cap 134 using any known method, such as by perforated ring 175. Top wall 165 can be generally flush or planar with cap top wall 120. Bottom peripheral edge 180 of cylindrical sidewall 170 defines opening 185. In some embodiments, tamper evident outer wall 160 includes internal engagement features 190 proximate to bottom peripheral edge 180 to directly engage container 10. In other words, tamper evident outer wall 160 can be configured to directly attach to the container 10.

As illustrated in FIG. 9*c*, upon initial use, cap 15 can be attached (e.g., threadably attached) to skirt 20 proximate to second joint 51, and tamper evident outer wall 160 can be directly attached to container 10 proximate to first joint 50. Attachment of tamper evident outer wall 160 to the container inhibits rotation of protective cap 15 relative to skirt 20. Removal and application of protective cap 15 requires less force compared to conventional containers (e.g., aerosol cans) that employ pulling and pushing by the user to remove the cap. Closure assembly 5 is therefore easier to operate, particularly for repeated use.

Figure 10A:
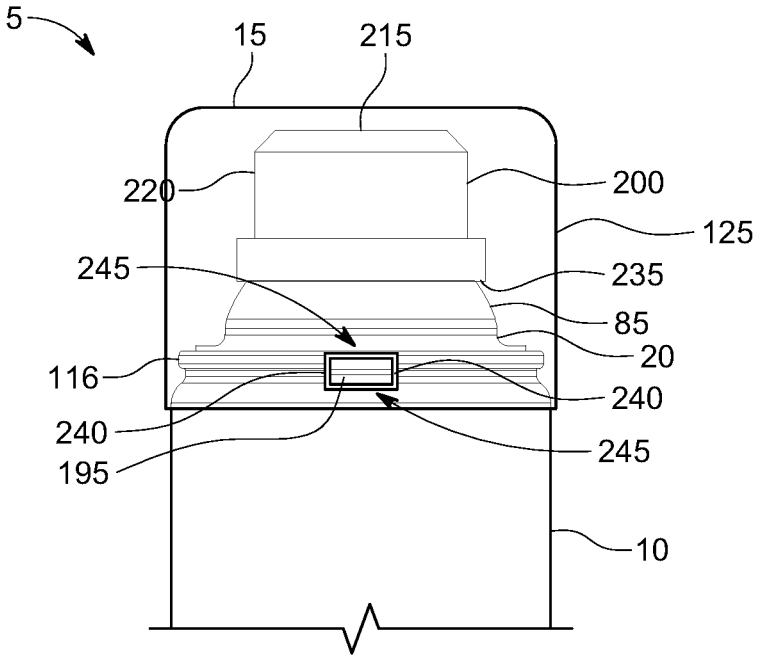
FIG. 10*a* is a front plan view of a closure assembly with a lock feature embodied as removable tabs of a protective cap and an inner cap positioned within the protective cap, engaged with a skirt in accordance with some embodiments of the presently disclosed subject matter.
Figure 10B:
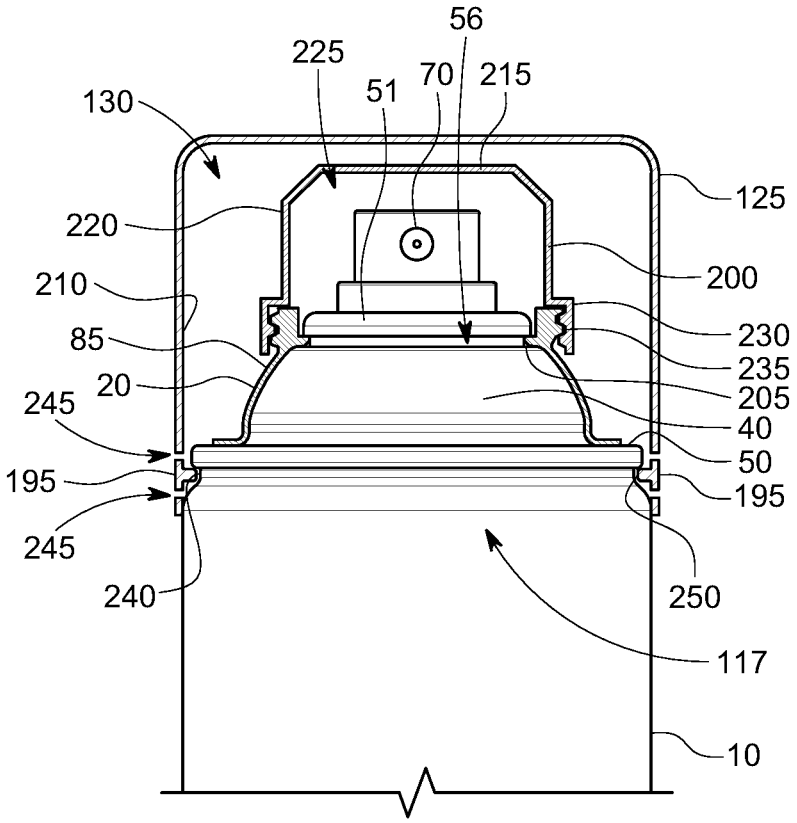
FIG. 10*b* is a partial cross-sectional side view of the assembly of FIG. 10*a*.

FIGS. 10*a* and 10*b* illustrate one embodiment of a closure assembly comprising a lock feature embodied as removable tabs 195 positioned within cap 15 and engaged with skirt 20 (e.g., threadably engaged). Any number of tabs 195 can be used, such as (but not limited to) 1-20. It should be appreciated that the number of tabs can depend on the size of the container. As shown, skirt 20 is attached to the container, such as at second joint 51 at the upper end of the container. The skirt includes inwardly extending protrusion 205 at interior surface 210 and is configured to be positioned between second joint 51 and tapered wall 40 of the container. Further, container attachment 85 of the skirt is configured to correspond to the shape of tapered wall 40 of the container extends between container first joint 50 and second joint 51.

The closure assembly illustrated in FIGS. 10*a* and 10*b* further includes re-attachable inner cap 200 positioned within protective cap interior 130. The re-attachable cap is smaller (e.g., in height, width, and/or diameter, etc.) compared the protective cap. The re-attachable cap includes top wall 215 and cylindrical sidewall 220 extending downwardly from the top wall to define a cap interior 225. However, the re-attachable cap can have any configuration so long as it houses the dispensing mechanism and fits within cap 15 interior. Inner cap 200 further includes any known connection elements, such as (but not limited to) internal threads 230 proximate to a bottom peripheral edge 235. Internal threads 230 are configured to removably and rotatably engage the external threads of skirt 20. When the re-attachable cap is attached to the skirt, actuator 70 of the container is positioned within cap interior 225.

Thus, the re-attachable cap is engaged (e.g., threadably engaged) with skirt 20, and protective cap 15 covers the re-attachable cap attached to the container. In this embodiment, the protective cap lacks internal threads.

Protective cap 15 can include one or more removable tabs 195 positioned in sidewall 125. Removable tabs 195 can be configured in any desired size and/or shape. The removable tabs can be connected to the sidewall of the protective cap by one or more known methods. For example, in some embodiments, one or more frangible bridges 240 can be used. The term "frangible bridge" refers to a rupturable or temporary element that connects two or more other elements. Grooves 245 are defined between the removable tabs and the sidewall of the protective cap. Each of the removable tabs can include an inwardly extending protrusion 250 configured to engage second recess 56 between second joint 51 and the cylindrical sidewall of the container. Removable tabs 195 are configured for attaching protective cap 15 to the container.

In some embodiments, a tool (e.g., blade, screwdriver, hair clip, etc.) can be inserted into at least one grooves 245 of removable tabs 195, to pry the tab from the protective cap. Such action removes protrusion 250 from the second recess, permitting removal of the protective cap and thereby providing access to re-attachable cap 200. In this way, initial use of the container requires more effort compared to subsequent uses.

Figure 11A:
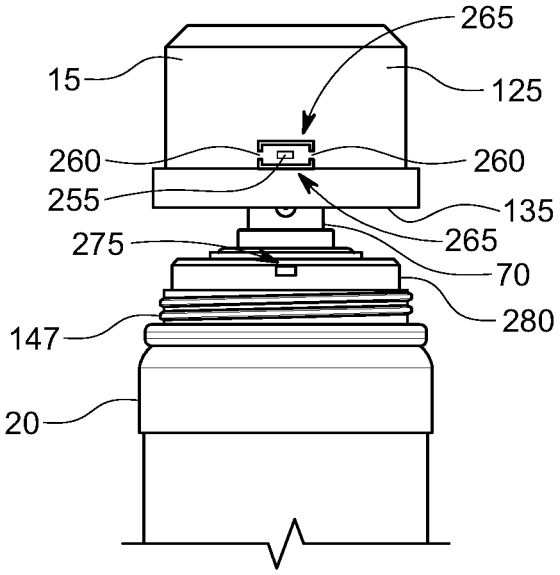
FIG. 11*a* is a side plan view of a closure assembly with a lock feature embodied as protective cap tabs configured to engage a skirt in a horizontal direction in accordance with some embodiments of the presently disclosed subject matter.
Figure 11B:
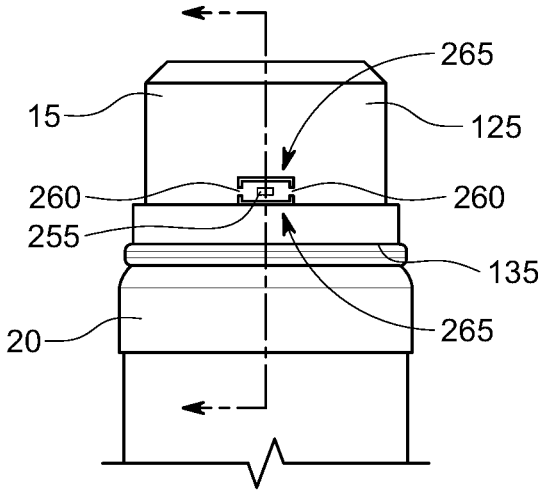
FIG. 11*b* is a front plan view of the assembly of FIG. 11*a*.
Figure 11C:
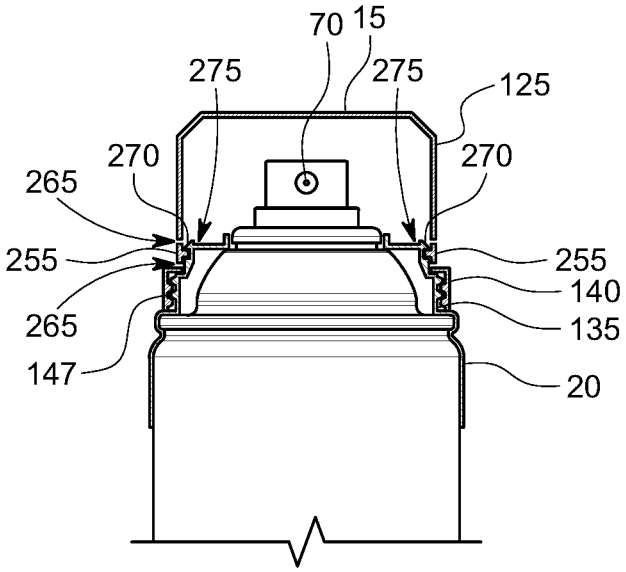
FIG. 11*c* is a cutaway view of the assembly of FIG. 11*b*.

FIGS. 11*a*-11*c* illustrate one embodiment of a closure assembly comprising a lock feature with at least one removable tab 255 configured in protective cap 15 to engage skirt 20 in a horizontal direction. However, it should be appreciated that the disclosed assembly is not limited to engagement in a horizontal direction, and the skirt can be engaged in any desired direction (vertical, angled, etc.). FIG. 11*a* illustrates that cap 15 can include internal threads positioned proximate to bottom peripheral edge 135. The protective cap can include one or more removable tabs 255 positioned in the sidewall of the protective cap, above the internal threads. The removable tabs are connected to sidewall 125 of the protective cap using any known mechanism, such as through the use of one or more frangible bridges 260. One or more grooves 265 are defined between the removable tabs and sidewall 125 of the protective cap. Each of the removable tabs includes an inwardly extending protrusion 270 configured to engage skirt 20. The removable tabs 255 are configured for attachment of protective cap 15 to container 10.

The skirt includes one or more notches 275 defined in a non-threaded portion of skirt sidewall 280 (e.g., above the external skirt threads). The notches are sized and shaped to receive protrusions 270 of the removable tab. In some embodiments, the skirt 20 is configured to engage first joint 50.

As shown in FIGS. 11*b* and 11*c*, to assemble the closure assembly, protective cap 15 is removably attached (e.g., threaded) onto skirt 20 until protrusions 270 of removable tab 255 engage notches 275 of the skirt. Once engaged, the protective cap is locked relative to the skirt until the removable tab is detached. Any known method can be used to detach the removable tab, such as use of a blade, screwdriver, or other tool. For example, a screwdriver can be inserted into a removable tab groove to pry the removable tab from cap 15. As a result, the protrusion is removed from notch 275, permitting removal of cap 15. The container actuator is thereby accessible to dispense contents 80. In this way, initial use of the container requires more effort compared to subsequent uses.

Figure 12A:
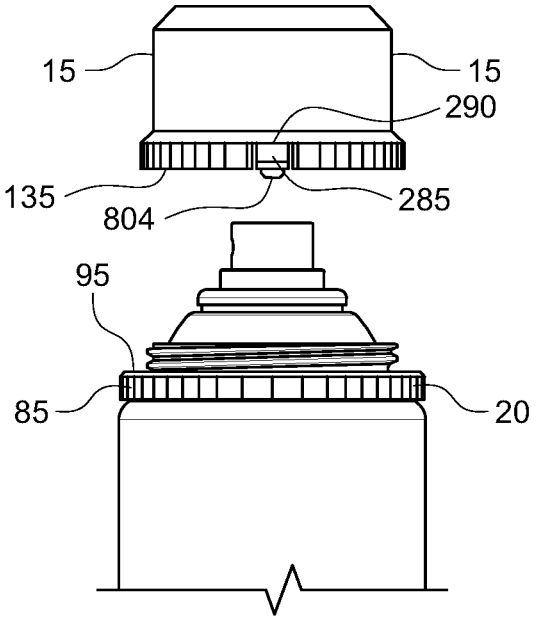
FIG. 12*a* is a front plan view of a closure assembly comprising a lock feature embodied as tabs in a protective cap configured to engage a skirt in a vertical direction in accordance with some embodiments of the presently disclosed subject matter.
Figure 12B:
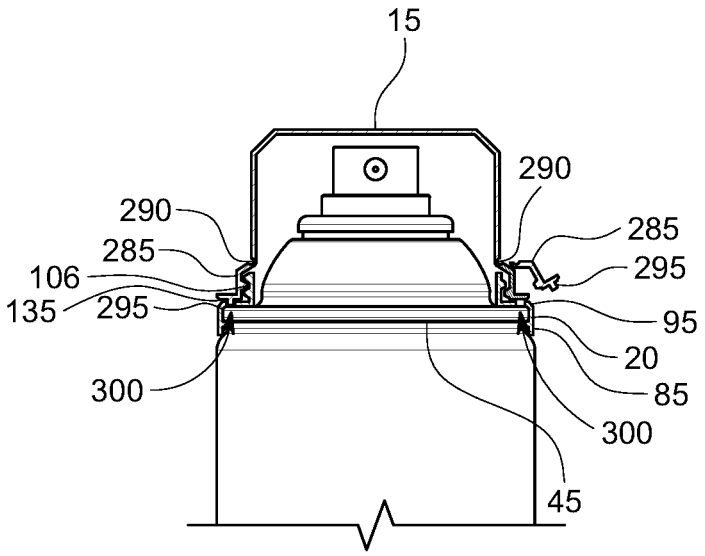
FIG. 12*b* is a partial cross-sectional view of the closure assembly of FIG. 12*a*.

FIGS. 12*a*-12*b* illustrate one embodiment of a closure assembly comprising a lock feature embodied as one or more movable tabs 285 positioned in protective cap 15. The movable tabs can be configured to engage skirt 20 in a vertical direction. However, it should be appreciated that the disclosed assembly is not limited to engagement in a vertical direction, and the skirt can be engaged in any desired direction (horizontal, angled, etc.).

Referring to FIG. 12*a*, cap 15 can include internal threads proximate to bottom peripheral edge 135. The protective cap includes one or more movable tabs 285 positioned in sidewall 125 at bottom peripheral edge 135 through the use of any desired mechanism. For example, in some embodiments, the moveable tabs are connected to sidewall 125 through the use of one or more hinges 290. Each of the movable tabs includes downwardly extending protrusion 295. Skirt 20 includes one or more notches 300 defined in an upper surface 95 of connector 100, configured to receive the movable tab protrusion. Notches 300 can be configured to receive one of the protrusions of the movable tab. In these embodiments, the skirt can be configured to engage first joint 50.

As shown in FIG. 12*b*, when protective cap 15 is engaged with skirt 20, movable tab 285 can alternate between an engaged position and a disengaged position. Particularly, in the engaged position, movable tab 285 is generally flush with cap sidewall 125, and the protrusion is engaged in notch 300 in upper surface 95 of attachment 100 of the skirt. In the engaged position, cap 15 is locked relative to the skirt. In the disengaged position, movable tab 285 is moved about hinge 290 upward to disengage the protrusion from notch 806. In the disengaged position, the protective cap is unlocked relative to the skirt and is free to rotate.

Figure 13A:
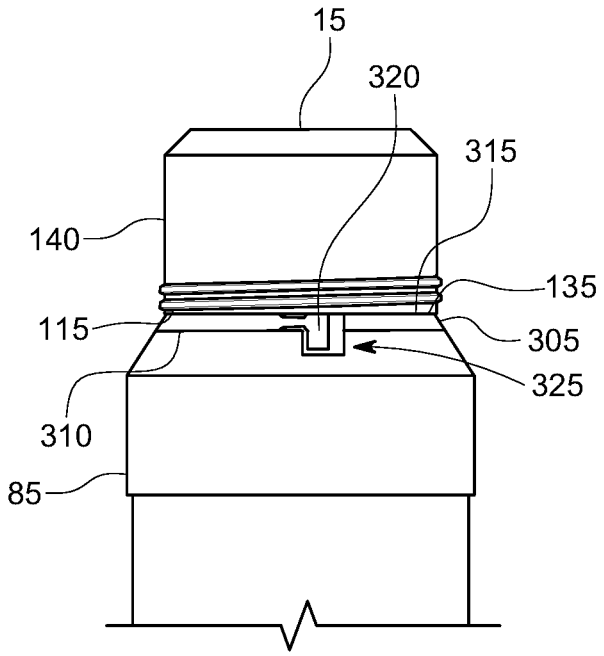
FIG. 13*a* is a front plan view of a closure assembly comprising a lock feature embodied as a tamper evident ring positioned between and integrally attached to both a protective cap and a skirt in accordance with some embodiments of the presently disclosed subject matter.
Figure 13B:
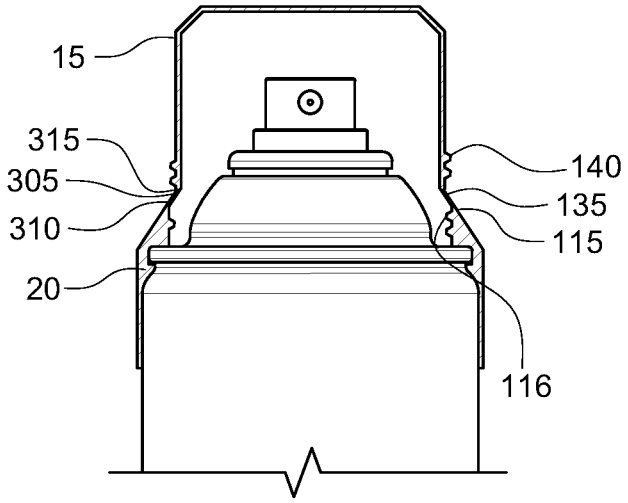
FIG. 13*b* is a partial cross-sectional side view of the assembly of FIG. 13*a*.

FIGS. 13*a*-13*d* illustrate one embodiment of a closure assembly comprising a lock feature embodied as tamper evident ring 305. As shown, the tamper evident ring can be positioned between and integrally attached to skirt 20 and protective cap 15. FIGS. 13*a* and 13*b* illustrate protective cap 15 comprising external threads 140 proximate to bottom peripheral edge 135. Further, skirt 20 includes a connection mechanism, such as internal threads 116 proximate to top peripheral edge 115. The top peripheral edge of the skirt is attached to bottom edge 310 of tamper evident ring 305 (e.g., including perforations to provide a perforated joint), and the bottom peripheral edge of the protective cap is attached to a top edge 315 of the tamper evident ring (e.g., including perforations to provide a perforated joint). When the tamper evident ring is attached, internal threads 116 of the skirt are offset and disengaged from external threads 140 of the protective cap. In some embodiments, the tamper evident ring can include a removal feature allowing for removal. For example, in some embodiments, pull tab 320 can be at least partially positioned in notch 325 proximate to top edge 315 of the tamper evident ring. Notch 325 can be configured to be larger than pull tab 320 to provide enough space therebetween for a user to grab the pull tab. Thus, protective cap 15 is not initially attached to skirt 20.

Figure 13C:
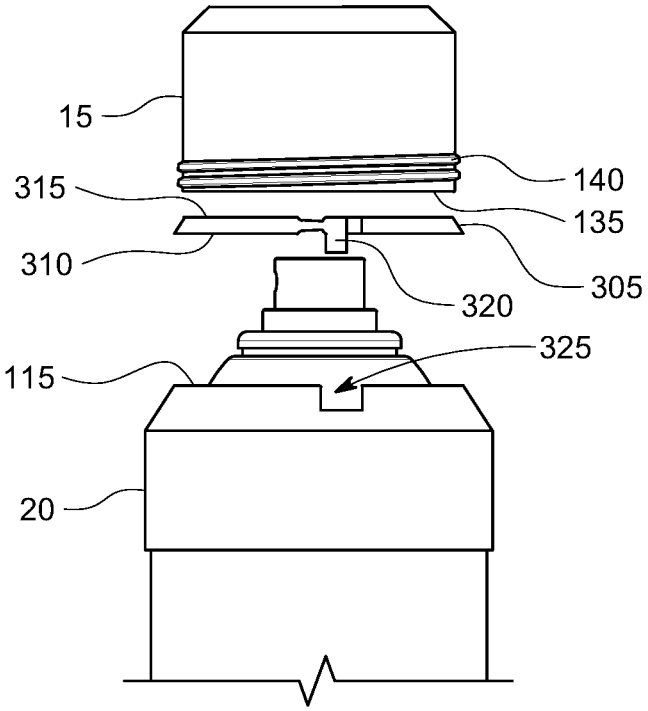
FIG. 13*c* is a front plan view of the assembly of FIG. 13*a* illustrating removal of the tamper evident ring in accordance with some embodiments of the presently disclosed subject matter.
Figure 13D:
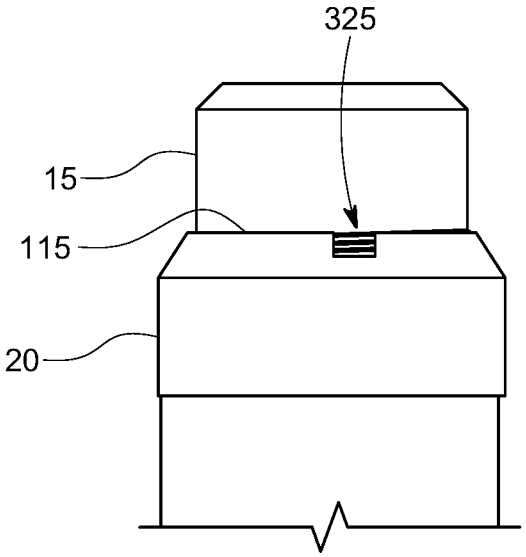
FIG. 13*d* is a front plan view of the assembly of 13*a* illustrating reattachment of the protective cap to the skirt after removal of the tamper evident ring.

Referring to FIG. 13*c*, to remove the tamper evident ring, a user grabs pull tab 320 and pulls circumferentially around protective cap 15 and skirt 20. As a result, the tamper evident ring separates from the protective cap and the skirt. As shown in FIG. 13*d*, once the tamper evident ring is removed, the protective cap can attach to the skirt, such as by engagement of external threads 140 of the protective cap with internal threads 116 of the skirt.

Figure 14A:
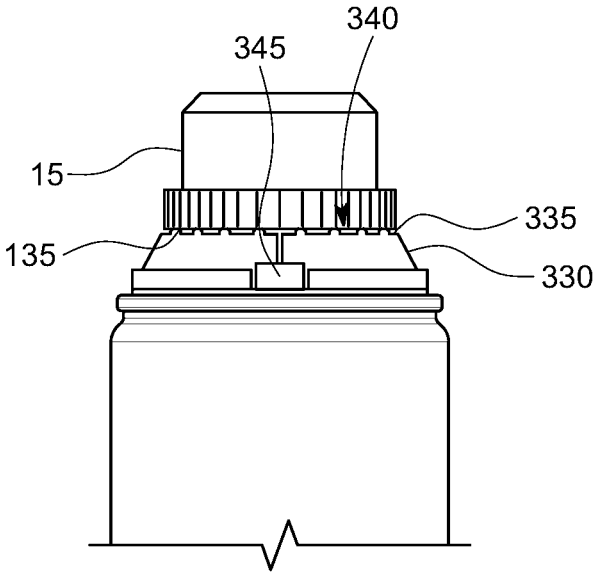
FIG. 14*a* is a front plan view of a closure assembly comprising a lock feature embodied as a tamper evident ring integrally attached to a protective cap and non-integrally attached to a skirt.
Figure 14B:
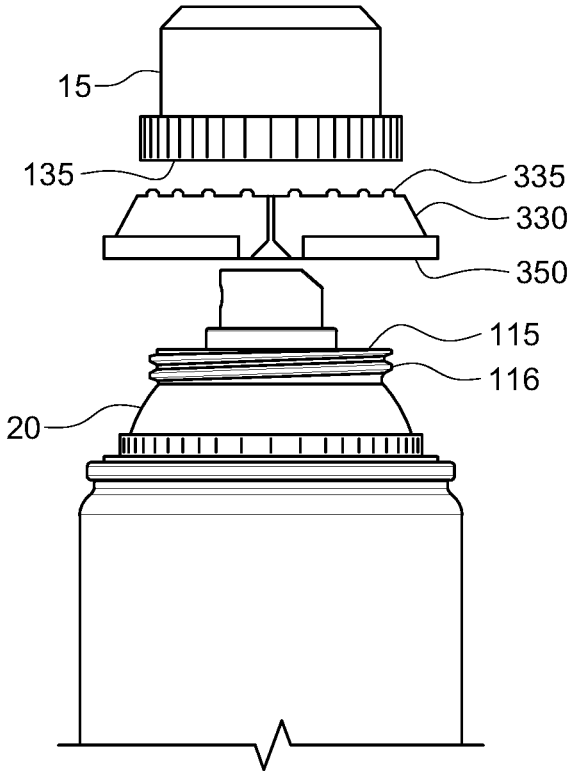
FIG. 14*b* is a front plan view of the assembly of FIG. 14*a* illustrating removal of the tamper evident ring and the protective cap from the skirt.

FIGS. 14*a*-14*b* illustrate one embodiment of a closure assembly comprising a lock feature embodied as tamper evident ring 330 integrally attached to protective cap 15 and non-integrally attached to skirt 20. As shown, the protective cap includes internal threads 140 proximate to bottom peripheral edge 135. Further, skirt 20 includes external threads 116 proximate to top peripheral edge 115. Bottom peripheral edge 135 of the protective cap is attached to top peripheral edge 335 of the tamper evident ring 330 (such as by perforations 340) to provide a perforated joint. When the tamper evident ring is attached, the external threads of the skirt are engaged with the internal threads of the protective cap. The tamper evident ring includes pull tab 345 or any other element to effect release of the pull tab positioned toward a bottom peripheral edge 350 of the tamper evident ring.

As shown in FIG. 14*a*, the protective cap is threadably attached to the skirt, and the tamper evident ring is integrally attached to protective cap 15 through perforations, providing a perforated joint. In some embodiments, the diameter of top peripheral edge 335 of the tamper evident ring is smaller than external threads 116 of skirt 20. In this way, the tamper evident ring is non-integrally attached to the skirt. Accordingly, the protective cap cannot be removed without first removing the tamper evident ring or overcoming a retaining force provided by the perforated joint.

To remove the tamper evident ring, a user grabs pull tab 345 and pulls circumferentially around protective cap 15 and skirt 20, as shown in FIG. 14*b*. As a result, the tamper evident ring separates from the protective cap and the skirt. Once the tamper evident ring is detached, the protective cap can be removed and reapplied to the skirt, such as through the engagement of internal cap threads with the external threads of skirt 20.

Figure 15A:
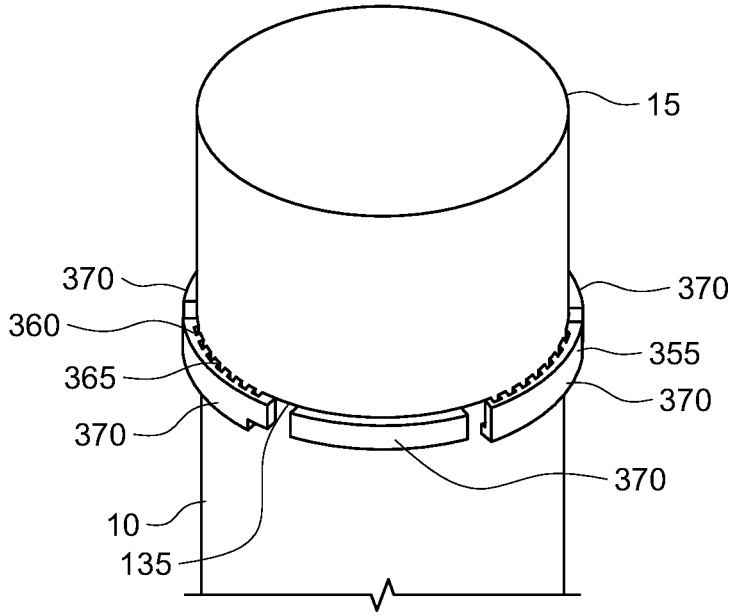
FIG. 15*a* is a perspective view of a closure assembly comprising a lock feature embodied as a tamper evident ring in accordance with some embodiments of the presently disclosed subject matter.
Figure 15B:
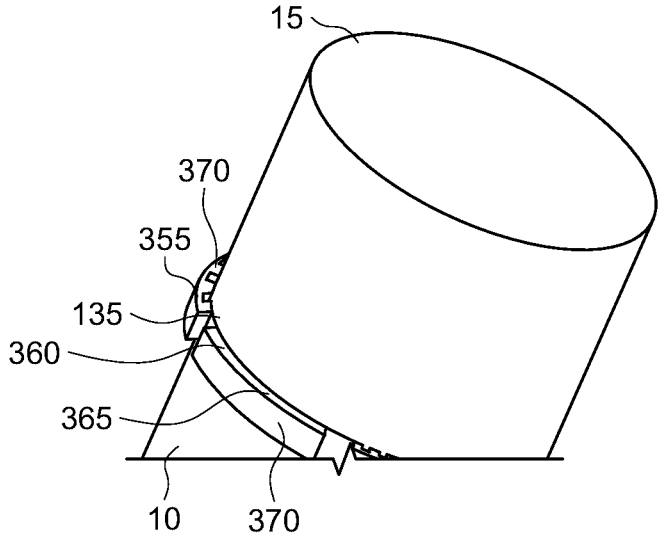
FIG. 15*b* is a magnified perspective view of the assembly of FIG. 15*a*.
Figure 15C:
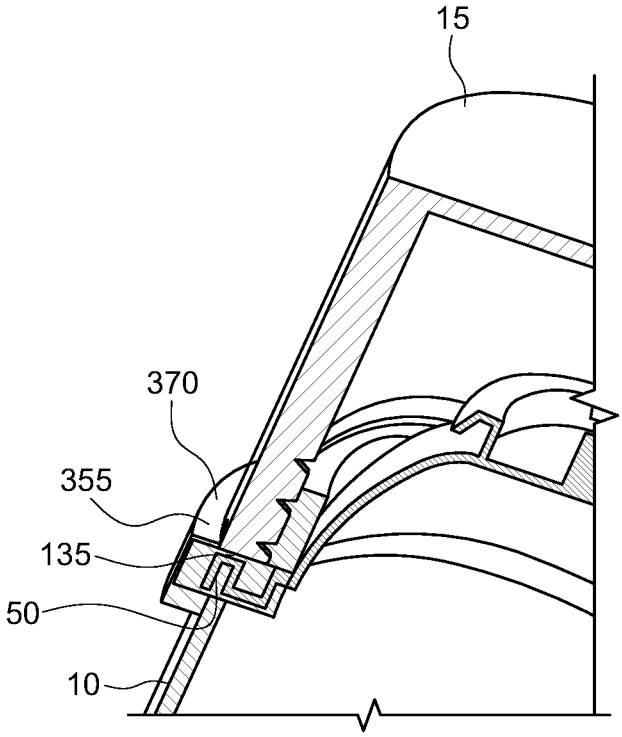
FIG. 15*c* is a partial cross-sectional view of the assembly of FIG. 15*b*.

FIGS. 15*a*-15*c* illustrate one embodiment of a closure assembly comprising a lock feature embodied as tamper evident ring 355 attached to protective cap 15 and container 10. As shown, bottom peripheral edge 135 of protective cap 15 is attached to top edge 360 of the tamper evident ring (such as by perforations 365 of a perforated joint). In some embodiments, the tamper evident ring includes a plurality of non-continuous sections 370. As illustrated in FIG. 15*c*, the bottom peripheral edge of the protective cap can be positioned above first joint 50. Tamper evident ring 355 extends from the bottom peripheral edge and around the first joint. The tamper evident ring is attached to protective cap 15 and the container. Accordingly, the protective cap cannot be removed without first removing the tamper evident ring or overcoming a retaining force provided by perforations 365. In some embodiments, a tool must be used to pry or break the tamper evident ring away from protective cap 15. It should be appreciated that any tool sized and shaped to remove the tamper evident ring can be used. Once tamper evident ring 355 is removed, the protective cap can be removed and reapplied to skirt 20 using any known mechanism (e.g., by engagement of internal threads 140 of the protective cap with external threads 116 of the skirt).

Figure 16A:
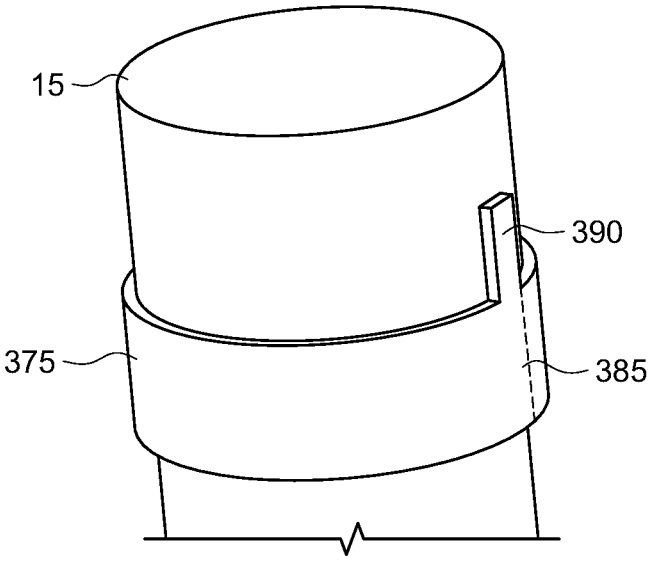
FIG. 16*a* is a perspective view of a closure assembly comprising a tamper evident seal in accordance with some embodiments of the presently disclosed subject matter.
Figure 16B:
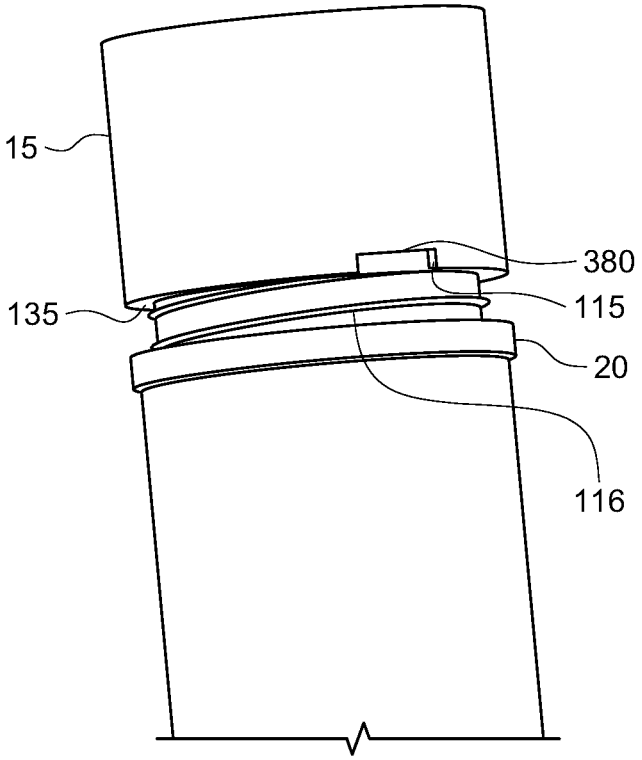
FIG. 16*b* is a perspective view of the assembly of FIG. 16*a* with the tamper evident seal removed, exposing a lock feature embodied as tabs of a protective cap.

FIGS. 16*a*-16*b* illustrate one embodiment of a closure assembly comprising tamper evident seal 375 and a lock feature embodied as tabs 380. As shown in FIG. 16*a*, tamper evident seal 375 can be configured to surround at least a portion of skirt 20 and cap 15. For example, the tamper evident seal can surround at least bottom peripheral edge 135 of the protective cap. Tamper evident seal 375 can include vertical perforation 385 and pull tab 390 proximate to the vertical perforation. In this way, a user may pull down on the pull tab to force a separation between ends of the tamper evident seal and then pull the pull tab circumferentially around the protective cap and the skirt. As a result, tamper evident seal 375 can be separated from the protective cap and the skirt.

Referring to FIG. 16*b*, once tamper evident seal 375 is removed, tabs 380 are exposed. In some embodiments, the bottom peripheral edge of the protective cap can be attached to top peripheral edge 115 of skirt 20 by tabs 380 that engage the external threads of the skirt, such as by adhesive, etc. In some embodiments, tabs 380 can be removed through the use of a tool (e.g., blade, screwdriver, etc.). Once the tabs are removed, the protective cap can be removed and reapplied to the skirt, such as by engagement of the internal threads of the protective cap with the external threads of the skirt.

Figure 17:
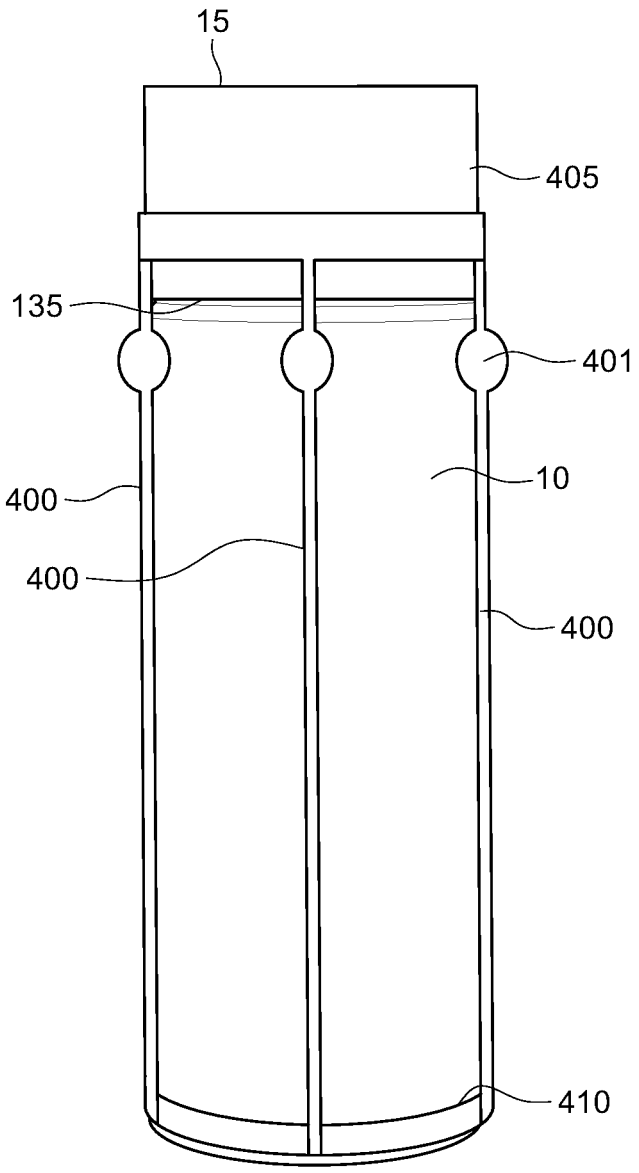
FIG. 17 is a front plan view of a closure assembly comprising a lock feature that includes tamper evident bands in accordance with some embodiments of the presently disclosed subject matter.

FIG. 17 illustrates one embodiment of a closure assembly comprising a lock feature that includes tamper evident bands 400 attached to protective cap 15 and container 10. The term "bands" refers to a wide variety of elements, such as straps, ropes, wires, sheets, that can be spaced apart around a container. The bands can include a circumferential head 405 attached to at least a portion of the protective cap using any known method (e.g., through the use of adhesive, mechanical elements, etc.). The tamper evident bands further include circumferential base 410 attached to the can using any known method. One or more tamper evident bands 400 can be attached (e.g., integrally attached) to circumferential head 405 and circumferential base 410. In some embodiments, the base can extend to the bottom surface of the container. The tamper evident bands can be circumferentially positioned around the protective cap and the container and oriented to extend across bottom peripheral edge 135 of the protective cap. In some embodiments, the bands can be vertically oriented as shown in FIG. 17. However, the presently disclosed subject matter is not limited and includes embodiments when the bands are horizontally oriented or angled relative to container 10. It should be appreciated that a variety of orientations can also be used (e.g., overlapping horizontally and vertically oriented bands).

Tamper evident bands 400 must first be ruptured before cap 15 can be removed from container 10. The bands can be ruptured using any known method, such as (but not limited to) pulling or pushing the bands with the hands, cutting with an implement (such as scissors), or the use of a tool (e.g., screwdriver). In some embodiments, bands 400 can include one or more tabs 401 that can be used to rupture the bands. The tabs can be configured in any desired size and/or shape. Once the tamper evident bands are cut and/or removed, the protective cap can be removed (e.g., unscrewed) and reapplied to skirt 20 as desired by the user.

Protective bands 400 can be constructed from any desired material, such as (but not limited to) wax, polymeric material, cardboard, paper, foil, metal, fabric, or combinations thereof.

Figure 18:
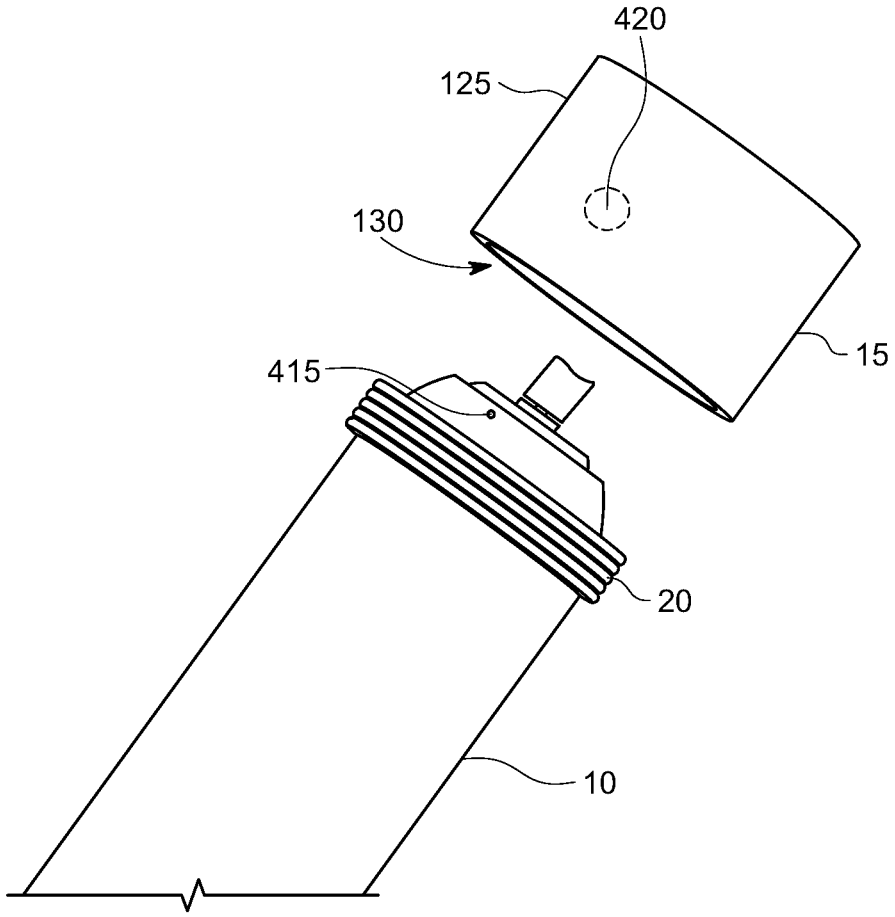
FIG. 18 is a perspective view of a closure assembly comprising a lock feature that includes a set screw positioned in a skirt in accordance with some embodiments of the presently disclosed subject matter.

FIG. 18 illustrates one embodiment of a closure assembly comprising a lock feature comprising mechanical closure 415 (e.g., an aperture for a set screw) positioned in skirt 20. Initially, the mechanical closure is positioned in the skirt such that it is not set against container 10. It should be appreciated that the disclosed assembly is not limited to a set screw and any removable element can be used (e.g., bolts, pins, and the like). As a result, protective cap 15 and skirt 20 can freely rotate around the container. Thus, the protective cap cannot be removed from the skirt until mechanical closure 415 is set against the container. For example, when a set screw is set against the container, the protective cap is configured to rotate relative to the skirt and the protective cap can be removed and reapplied to the skirt.

In some embodiments, protective cap 15 can include frangible portion 420 within sidewall 125 of the protective cap. The frangible portion is configured to sever from the protective cap to provide access to set screw 415 within the protective cap. A user can puncture frangible portion 420 with any known tool (e.g., blade or screwdriver) to form an opening and thereby provide access to cap interior 130. A user can then use the tool to apply set screw 415 against container 10.

Figure 19A:
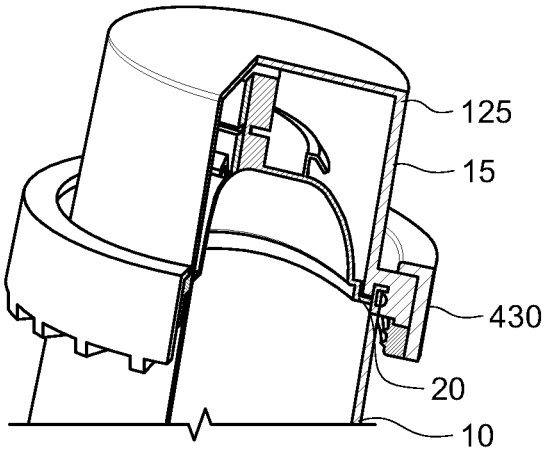
FIG. 19*a* is a partial cross-sectional view of a closure assembly comprising a tamper evident ring covering a lock feature embodied as a screw positioned in a protective cap in accordance with some embodiments of the presently disclosed subject matter.
Figure 19B:
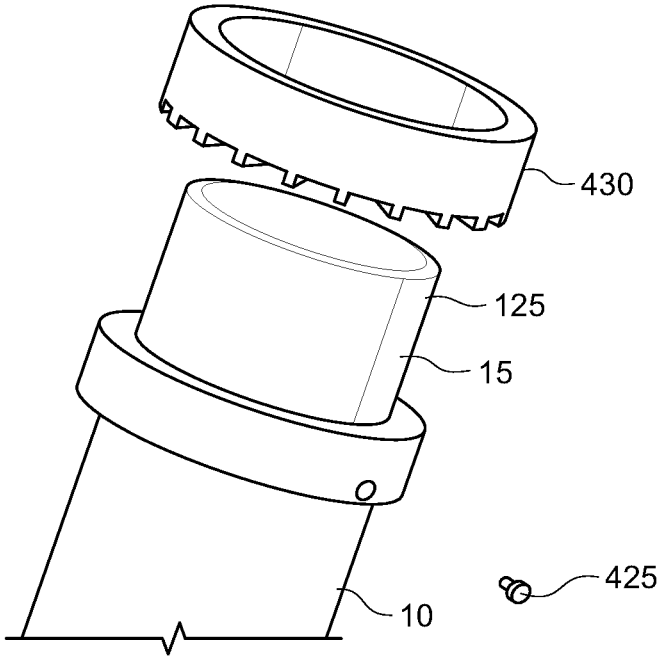
FIG. 19*b* is a perspective view of the assembly of FIG. 19*a* including removal of the tamper evident ring.

FIGS. 19*a*-19*b* illustrate one embodiment of a closure assembly comprising a lock feature embodied as screw 425 positioned in protective cap 15 and tamper evident seal 430 covering screw 425. Again, the presently disclosed subject matter is not limited to screw 425 and any connecting element can be used (e.g., pins, bolt, clips). The tamper evident seal is attached to sidewall 125 of the protective cap and covers the screw in the sidewall of the protective cap. Removing tamper evident seal 430 exposes screw 425.

Initially, screw 425 is positioned in sidewall 125 of the protective cap and set against skirt 20 and/or container 10, such that protective cap 15 cannot rotate relative to skirt 20 and/or container 10. Thus, the screw at least partially attaches the protective cap to the container. To remove the protective cap, the screw must be rotated so that it no longer contacts the skirt and/or container 10. Once screw 425 is moved, protective cap 15 can be removed and reapplied to skirt 20.

Figure 20:
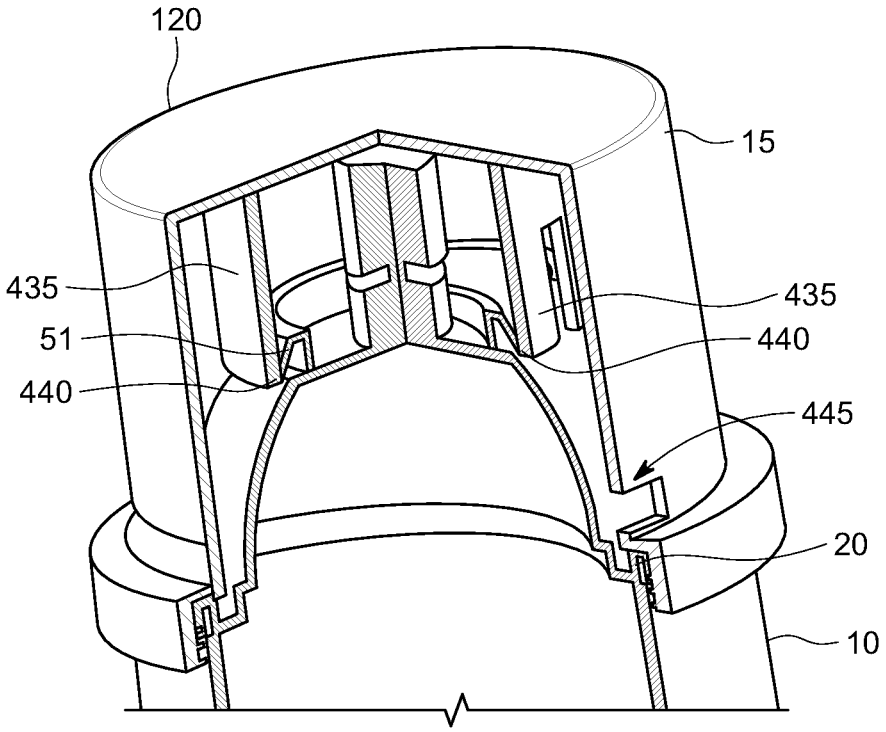
FIG. 20 is a partial cross-sectional view of a closure assembly comprising a lock feature with inwardly biased cantilever arms in accordance with some embodiments of the presently disclosed subject matter.

FIG. 20 illustrates one embodiment of a closure assembly with a lock feature embodied as inwardly biased cantilever arms 435 configured to engage container 10 and to deform upon removal of protective cap 15. The cantilever arms extend downwardly from an interior surface of top wall 120 of the protective cap. The cantilever arms can be circumferentially positioned around a center axis of the protective cap. Each of the cantilever arms can include prong 440 configured to engage second joint 51 of the container. Cantilever arms 435 can be configured to engage the upper end of the container by engagement of the prongs with the second joint. The cantilever arms can be configured to deform upon removal of the protective cap from the container. In other words, a rotational force is applied to protective cap 15 sufficient to deform and/or break the cantilever arms. In some embodiments, the protective cap includes side opening 445 in the sidewall to provide access for insertion of a tool to elastically deform the cantilever arms and pry the prongs from second joint 51 to remove protective cap 15. Once the protective cap is removed, the cap can be removed and reapplied to skirt 20 with less force than the initial force.

Figure 21A:
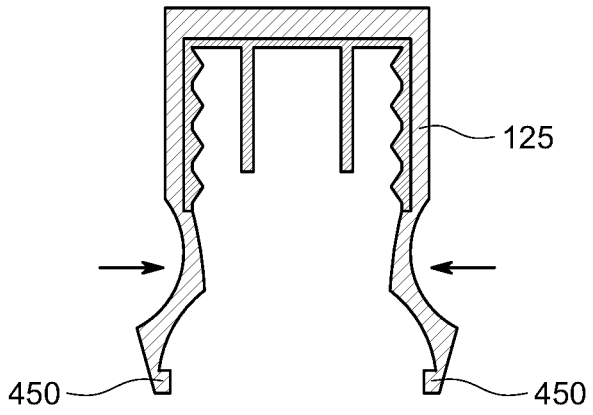
FIG. 21*a* is a partial cross-sectional side view of a protective cap for use with a closure assembly comprising a lock feature embodied as a gripper at a bottom of a protective cap in accordance with some embodiments of the presently disclosed subject matter.
Figure 21B:
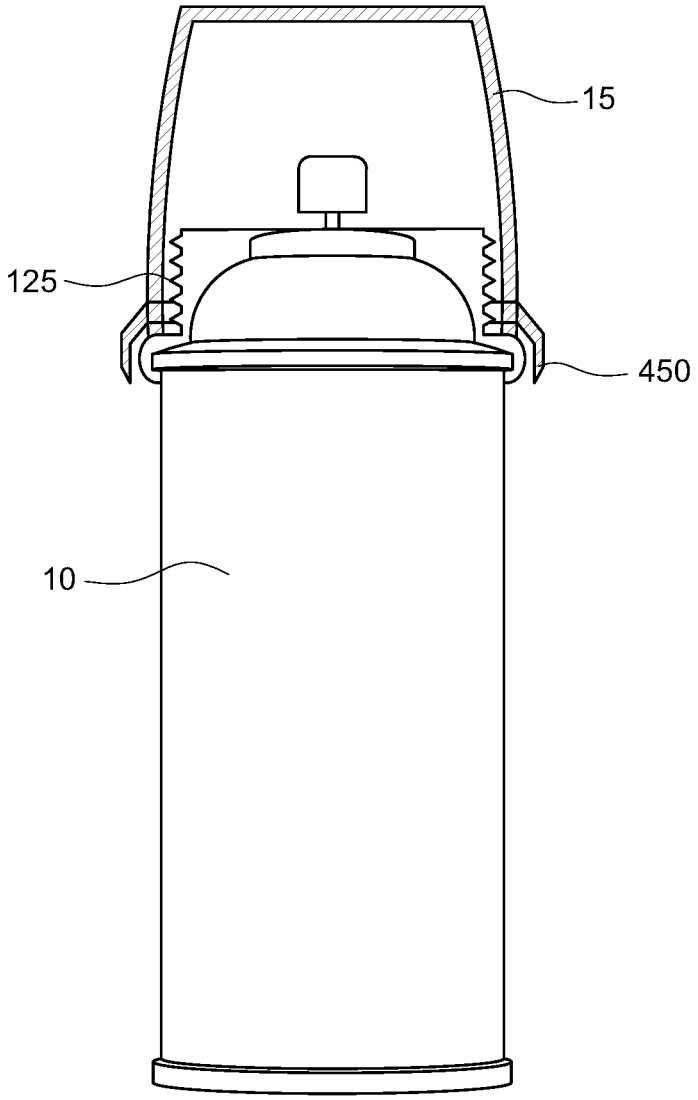
FIG. 21*b* is a side plan view of the assembly of FIG. 21*a*.

FIGS. 21*a* and 21*b* illustrate one embodiment of protective cap 15 comprising a lock feature embodied as gripper 450 at a bottom of the protective cap and configured to engage container 10. The term "gripper" refers to any of a wide variety of elements that can securely grasp and release another element. In certain embodiments, the gripper is configured to engage first joint 50 to prevent removal of protective cap 15 from skirt 20 and/or container 10. The gripper can be configured to disengage from the container by elastic deformation of the protective cap caused by squeezing the sidewalls of the protective cap. The squeezing can be affected by a user's grip (e.g., fingers) or an implement, such as pliers. Thus, squeezing sidewalls 125 of the protective cap forces grippers 450 to flex out of the way, thereby allowing removal of the protective cap from the skirt and/or container 10.

Figure 22A:
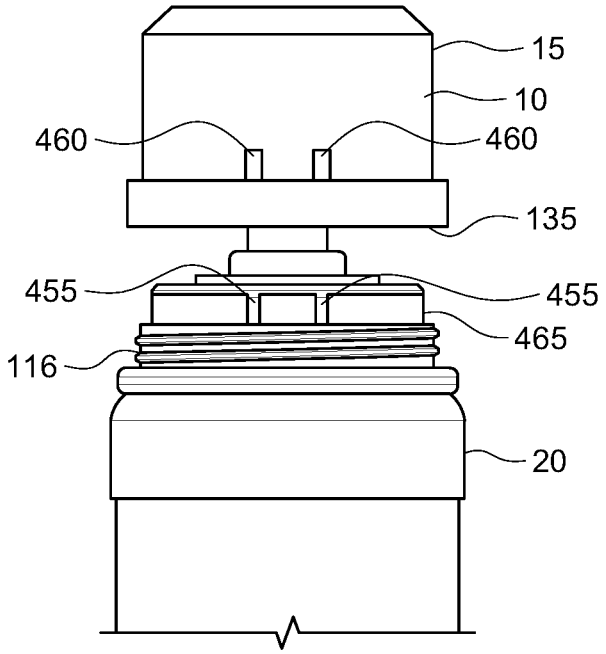
FIG. 22*a* is a front plan view illustrating a closure assembly with an inner lock opening of a skirt aligned with an outer lock opening of a protective cap in accordance with some embodiments of the presently disclosed subject matter.
Figure 22B:
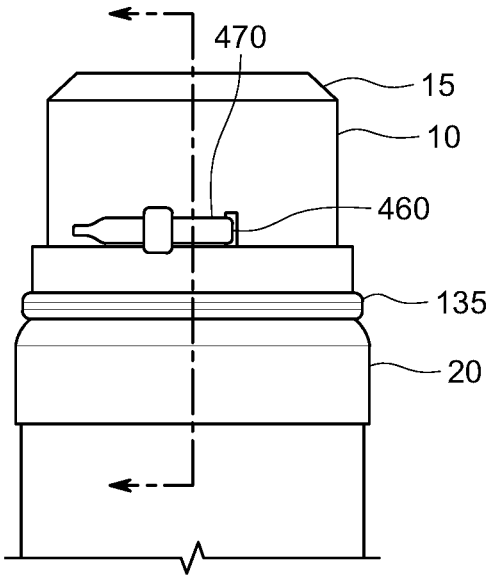
FIG. 22*b* is a front plan view of the assembly of FIG. 22*a* with a lock feature embodied as a cable tie.
Figure 22C:
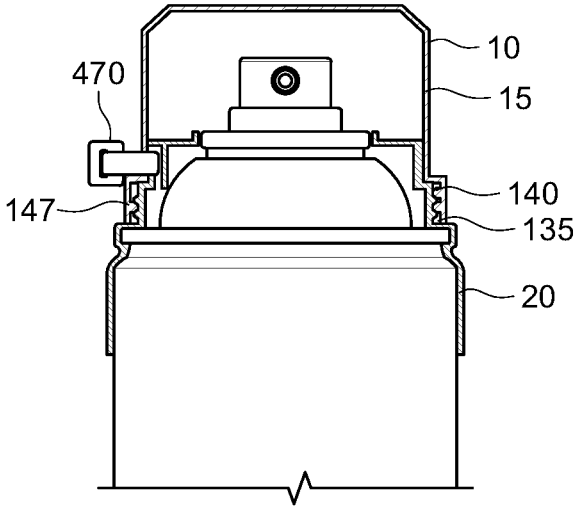
FIG. 22*c* is a partial cross-sectional view of the container of FIG. 22*a*.

FIGS. 22*a*-22*c* are views of another embodiment of a container assembly with inner lock opening 455 of skirt 20 aligned with outer lock opening 460 of the protective cap. Referring to FIG. 22*a*, the protective cap can include internal threads proximate to a bottom peripheral edge of the protective cap. The protective cap includes two outer lock openings 460 defined in sidewall 125 of the protective cap above internal threads 140 of protective cap 15. The skirt includes one or more inner lock openings 455 defined in a non-threaded sidewall 465 of the skirt above external threads 116 of the skirt.

Referring to FIGS. 22*b*-22*c*, protective cap 15 is threaded onto skirt 20 until inner lock openings 455 of the skirt align with outer lock openings 460 of the protective cap. Once aligned, a lock element, such as a cable tie 470 (which can also be referred to as a zip tie) can be inserted through first inner lock opening 455 and first outer lock opening 460 and then fed through second outer lock opening 460 and first inner lock opening 455. It should be appreciated that the lock element can include any element that releasably attaches the skirt and cap together via openings 460. Thus, when inner lock opening 455 is registered with outer lock opening 460, the inner lock openings and the outer lock openings are configured to receive a locking element (e.g., cable tie) therethrough. The protective cap is then locked relative to the skirt until the lock element is removed, such as by cutting. In this way, more effort is required for initial use than for subsequent uses.

Figure 23:
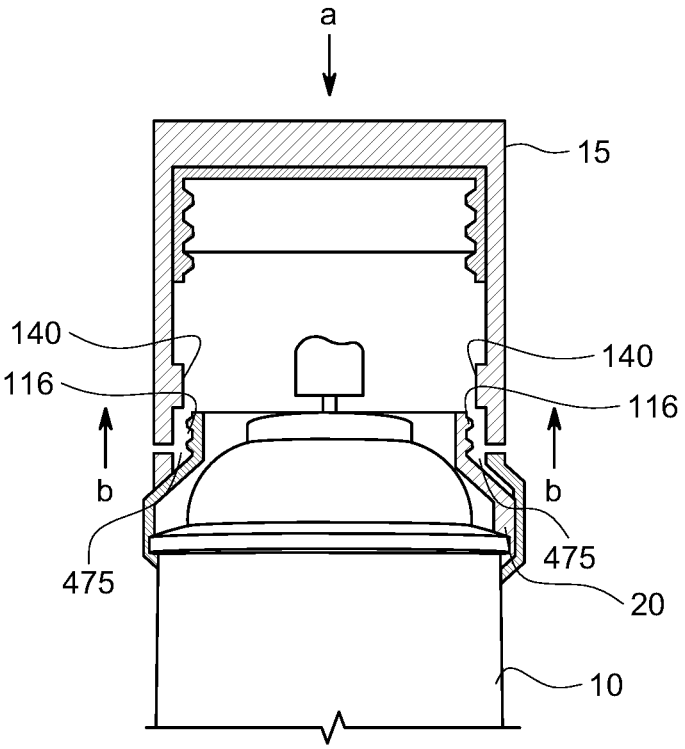
FIG. 23 is a partial cross-sectional view of a closure assembly comprising a biasing element to separate threads of a protective cap from threads of a skirt in accordance with some embodiments of the presently disclosed subject matter.

FIG. 23 is a cutaway view of another embodiment of a closure assembly comprising biasing element 475 to separate internal threads 140 of protective cap 15 from external threads 116 of skirt 20. The biasing element is configured to axially bias the protective cap relative to the skirt such that the external threads of the skirt are disengaged from the internal threads of the protective cap. The internal threads of the protective cap are configured to engage the external threads of the skirt by application of an axial force A to overcome a biasing force B of biasing element 475.

Figure 24A:
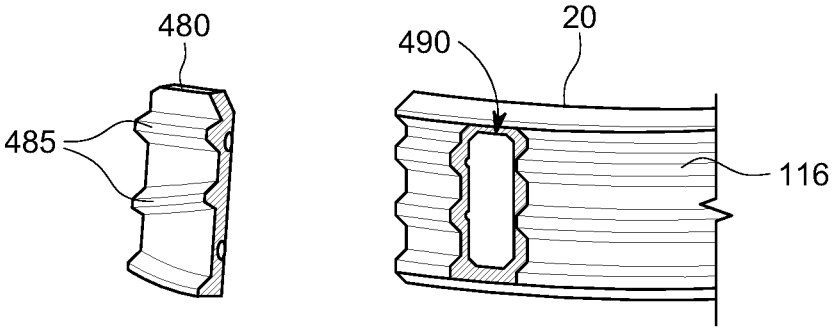
FIG. 24*a* is a partial cross-sectional view of a lock feature of a closure assembly comprising a thread mismatch removably positioned within threads of a skirt in accordance with some embodiments of the presently disclosed subject matter.
Figure 24B:
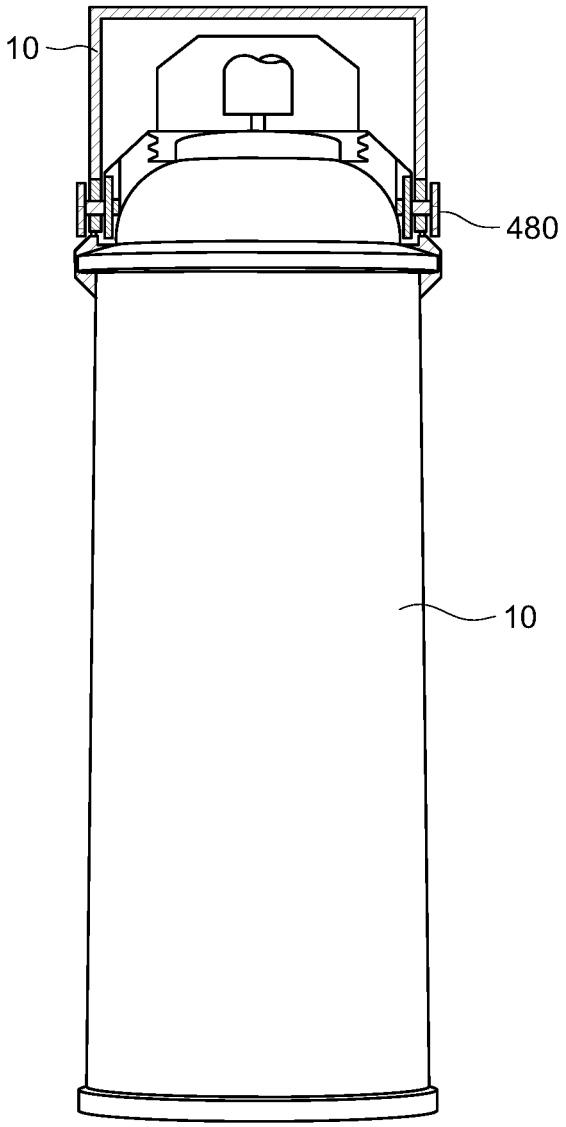
FIG. 24*b* is a front plan view of a container comprising the lock feature of FIG. 24*a*.

FIGS. 24*a* and 24*b* illustrate a lock feature embodied as a thread mismatch element 480 (e.g., deformed thread and/or a mismatch in thread pitch) removably positioned within the external threads of the skirt. The thread mismatch element includes thread 485 having a different thread pitch and/or alignment compared to the external threads of skirt 20. Initially, the thread mismatch element is positioned in an opening 490 of the external threads of the skirt. The protective cap cannot be removed from the skirt until thread mismatch element 480 is removed. The deformed thread thus prevents the cap from being removed (e.g., unscrewing). Once the deformed portion is removed, the cap is free to be unscrewed. Once the protective cap is initially removed, it can be removed and reapplied to skirt 20 with less force than the initial force.

Figure 25A:
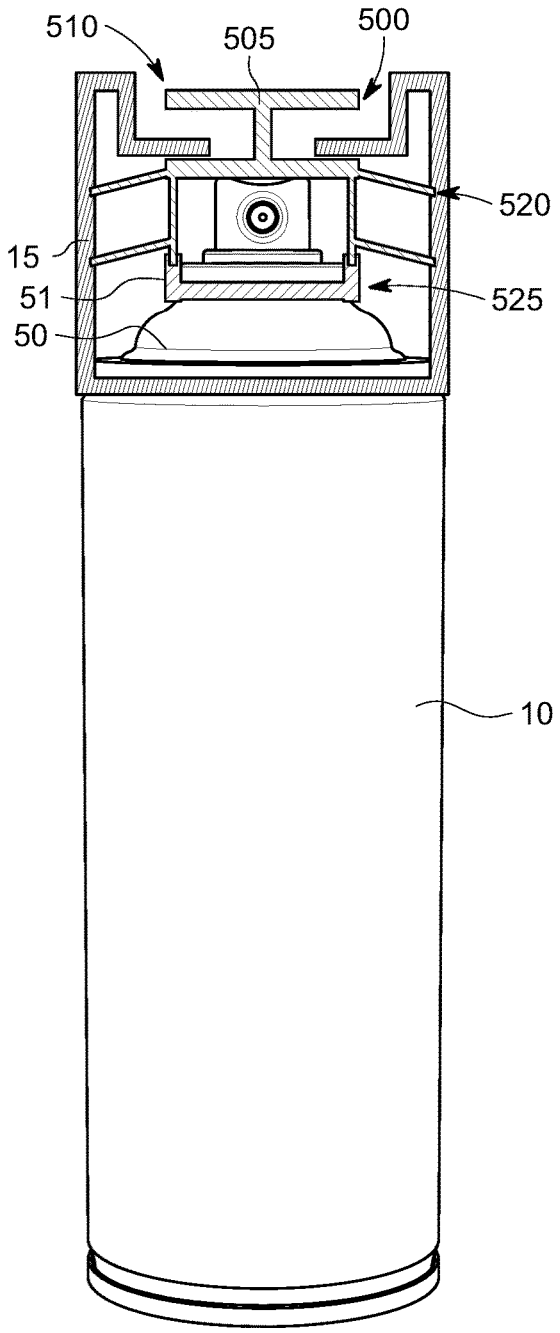
FIGS. 25*a* and 25*b* are front plan views of containers comprising a closure assembly lock feature configured as a twist knob in accordance with some embodiments of the presently disclosed subject matter.

FIG. 25*a* illustrates one embodiment of a closure assembly comprising a twist knob. The term "twist knob" broadly refers to any type of handle that can be activated between a first and second position, such as activating by turning by hand. As shown, knob 500 extends through a portion of protective cap 15 (e.g., the top wall of the cap). Knob 500 is not limited and can include any element that can rotate relative to container 10 and/or cap 15. The knob includes grip 505 to allow a user to turn the knob. In some embodiments, cap 15 can include recess 510 to allow a user more room to access grip 505. Knob 500 includes interior 515 housed within the cap interior that includes one or more circumferentially extending tabs 520 that attach to the interior cap surface. The knob further includes central ring 525 that anchors the knob, and is positioned around first or second joint 50, 51. Alternatively, the central ring can be positioned around any surface of the tapered container wall (under the cap when attached). When a user twists grip 505, the knob rotates and causes tabs 520 to break and become unattached from either the cap interior or the knob. Prior to rupture of tabs 520, the cap cannot be removed from the container because the tabs act as a restraint, connecting the cap and the container.

Figure 25B:
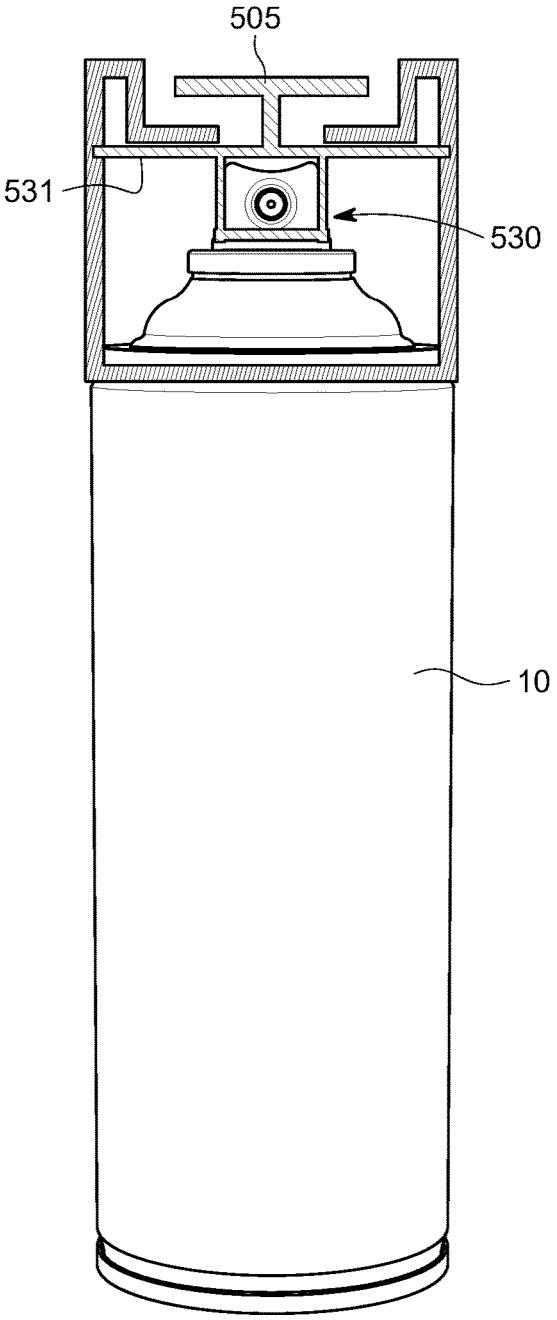

As illustrated in FIG. 25*b*, in some embodiments, knob 500 includes a portion of material 530 that extends under nozzle 75 and a second portion of material 531 that extends across a surface of the cap interior, as shown. Once grip 505 is turned, second portion of material 531 is ruptured, allowing the cap to be removed. If a user attempts to remove the cap without first turning the knob, the nozzle will be removed with the cap, rendering the container unusable.

Figure 26:
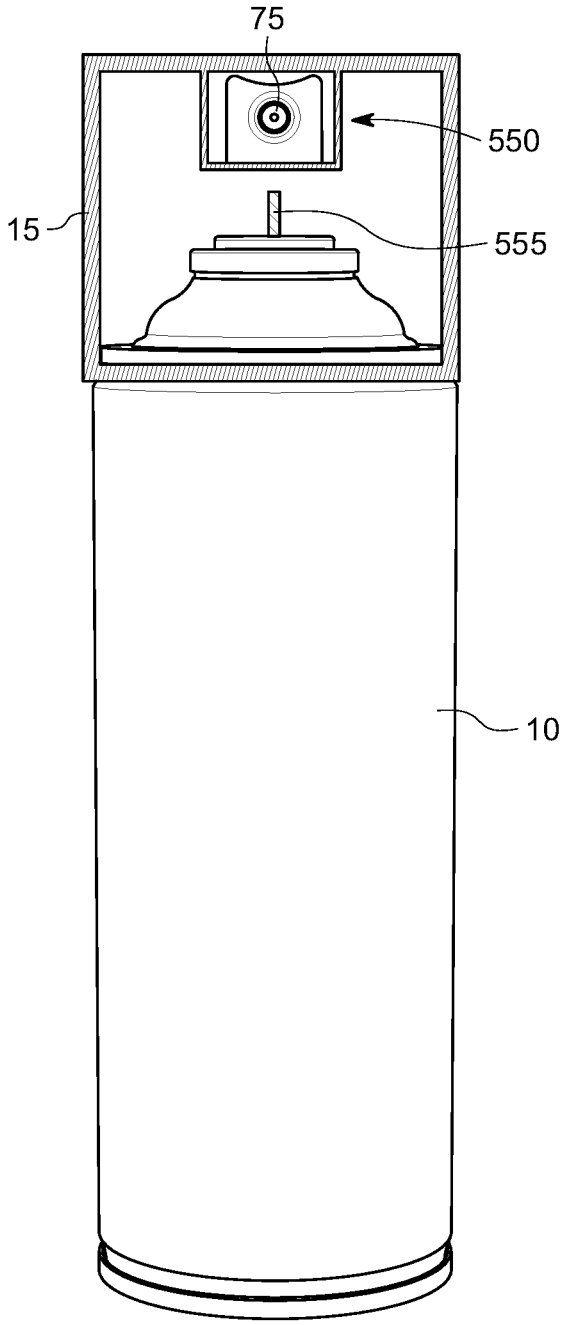
FIG. 26 is a front plan view of a closure assembly comprising a separate compartment that houses a dispensing nozzle in accordance with some embodiments of the presently disclosed subject matter.

FIG. 26 illustrates an embodiment of a closure assembly that includes a lock feature with the container nozzle head encapsulated separately within the cap interior. As shown, the cap interior includes compartment 550 that is sized and shaped to accommodate nozzle 75. In some embodiments, the compartment is constructed from frangible materials that allows a user to easily rupture one or more walls to access the nozzle. In other embodiments, the compartment can be configured to twist off from the cap interior to release the nozzle. Compartment 550 is not limited and can include tabs or other access elements known in the art. In use, cap 15 is removed from container 10. The user can then rupture compartment 550 by a twisting action, tabs, use of a knife, etc. to access nozzle 75. The user can then position the nozzle on the associated tubing 555 and can then dispense the container contents.

Figure 27A:
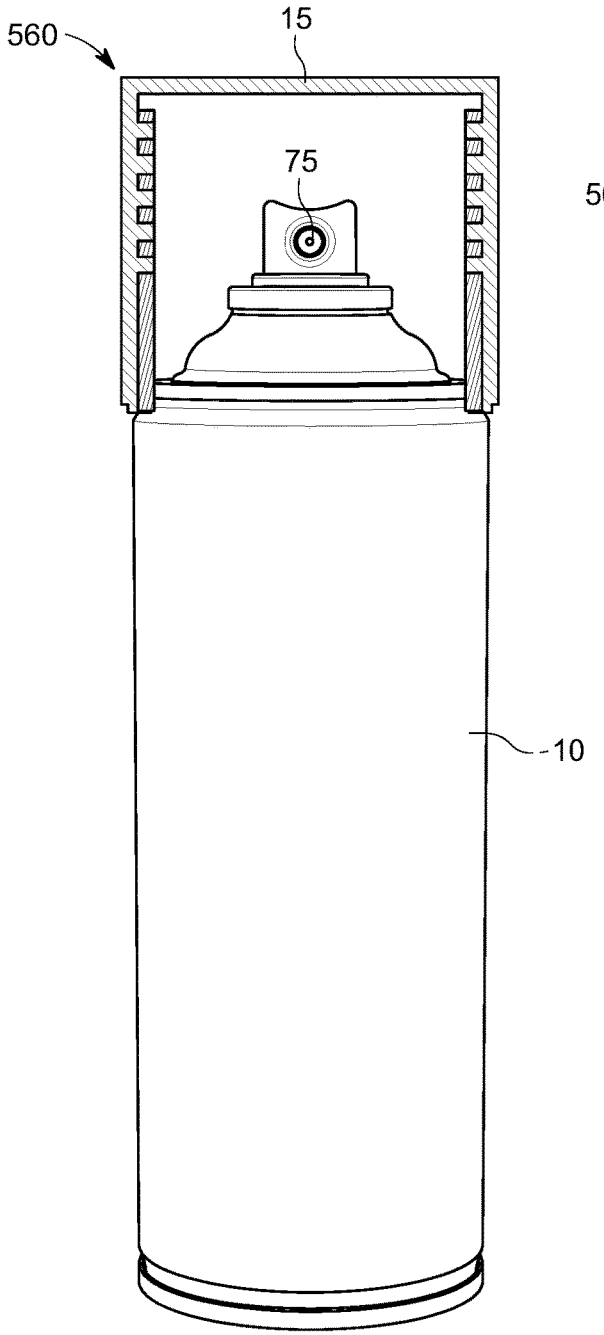
FIG. 27*a* is a front plan view of a closure assembly configured as a removable threaded ring in accordance with some embodiments of the presently disclosed subject matter.
Figure 27B:
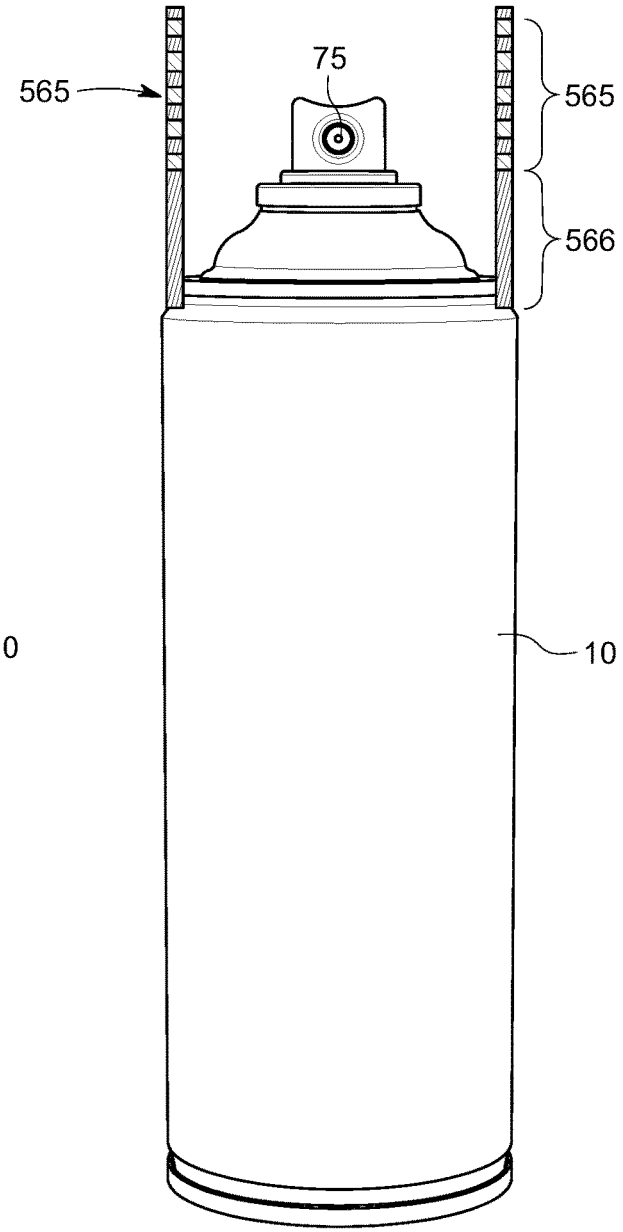
FIG. 27*b* is a front plan view of the container of FIG. 27*a* with the cap removed.
Figure 27C:
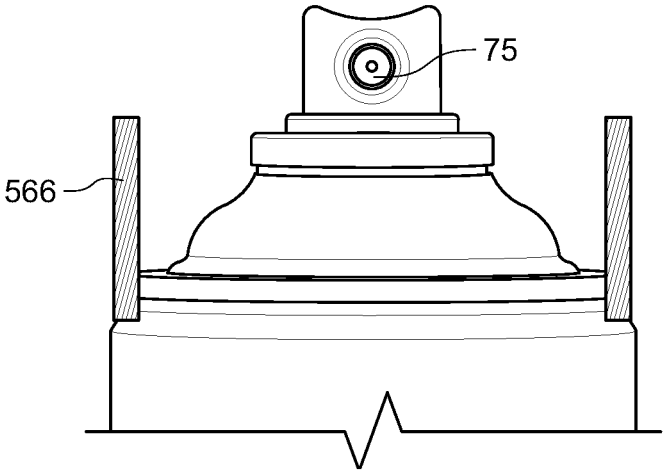
FIG. 27*c* is a front plan view of the container of FIG. 27*a* with the removable portion of the threaded ring removed.

FIGS. 27*a*-27*c* illustrate an alternate embodiment of a closure assembly with a lock feature that comprises a threaded ring. Particularly, cap 15 is positioned on the container as described herein above. Threaded ring 560 is releasably or permanently attached to the tapered wall of container 10 (e.g., at first joint 50, second joint 51, skirt 20, or any other surface). The threaded ring can be attached using any known method, such as adhesive, welding, mechanical closures, and the like. The threaded ring functions as a wall, circumferentially surrounding the top portion of the can. Specifically, threaded ring 560 is configured to have a height that is above the level of nozzle 75. Thus, once cap 15 is removed, a user cannot effectively dispense the contents from the container. If the nozzle is depressed, the contents will immediately come into contact with the threaded ring and will be contained. As shown in FIG. 27*b*, the threaded ring includes upper removable section 565 that can be removed at any desired time (e.g., by the user after container 10 is purchased and brought home) and lower section 566. Removable section 565 can include any known element, such as a pull tab to separate the removable section, a frangible seal separating the removable section, etc. Once the removable portion has been removed, the height of threaded ring 560 is below the dispensing stream of nozzle 75, as shown in FIG. 27*c*. In this way, the container contents can be effective dispensed.

Figure 28:
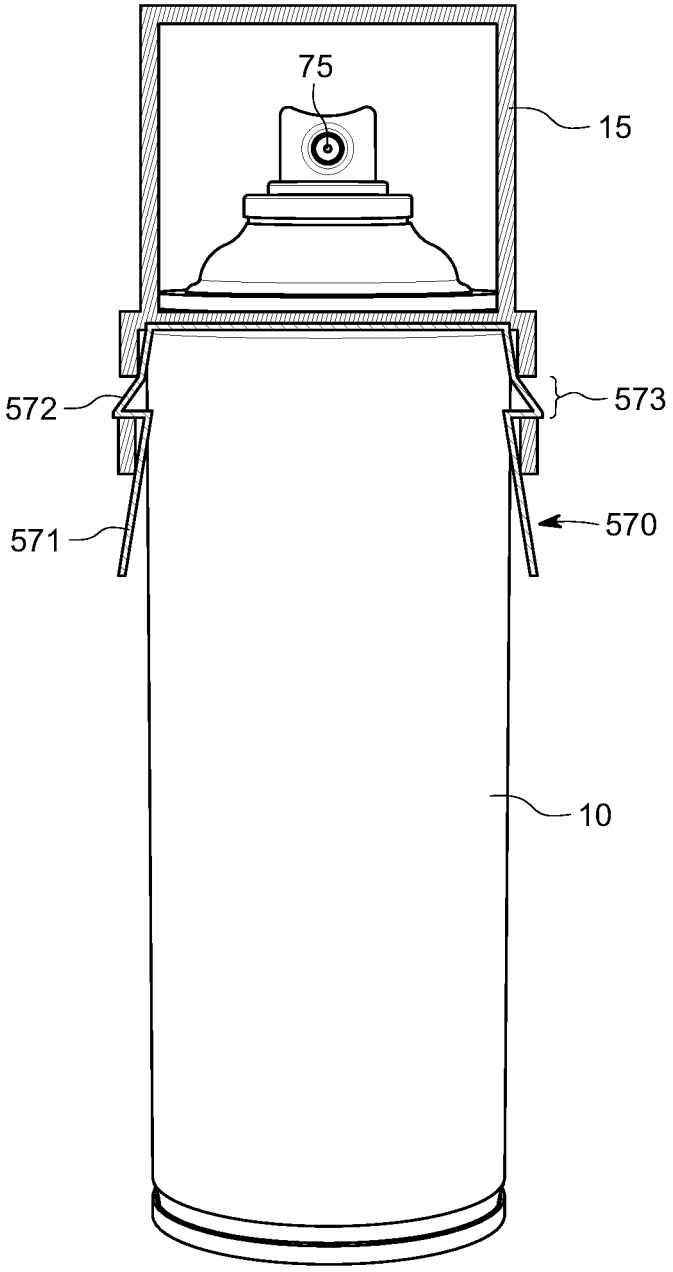
FIG. 28 is a front plan view of a closure assembly comprising a cap locked with spring snap tabs in accordance with some embodiments of the presently disclosed subject matter.

FIG. 28 illustrates one embodiment of a closure assembly with a lock feature comprising a cap locked with spring snap tabs. As shown, nozzle 75 is housed within the interior of cap 15. The cap is locked in position by one or more snaps 570 positioned adjacent to the container base. The snaps include arms 571 and ridge 572. The ridge can be configured as any protrusion that extends into one or more cap apertures 573. The arms extend below the cap and are angled outward, such that when a user squeezes arms inward (toward the container body), the ridge moves away from aperture 573 and the cap can be removed, such as by unscrewing.

Figure 29A:
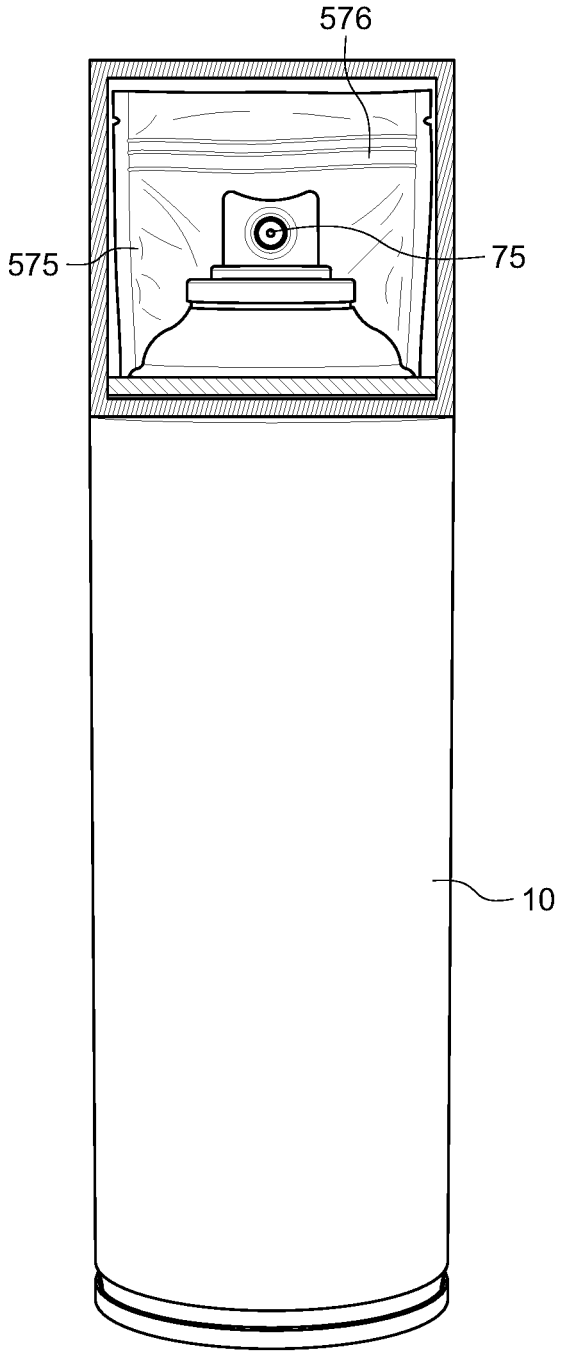
FIGS. 29*a* and 29*b* are front plan views of closure assemblies comprising a lock feature configured as a protective covering in accordance with some embodiments of the presently disclosed subject matter.
Figure 29B:
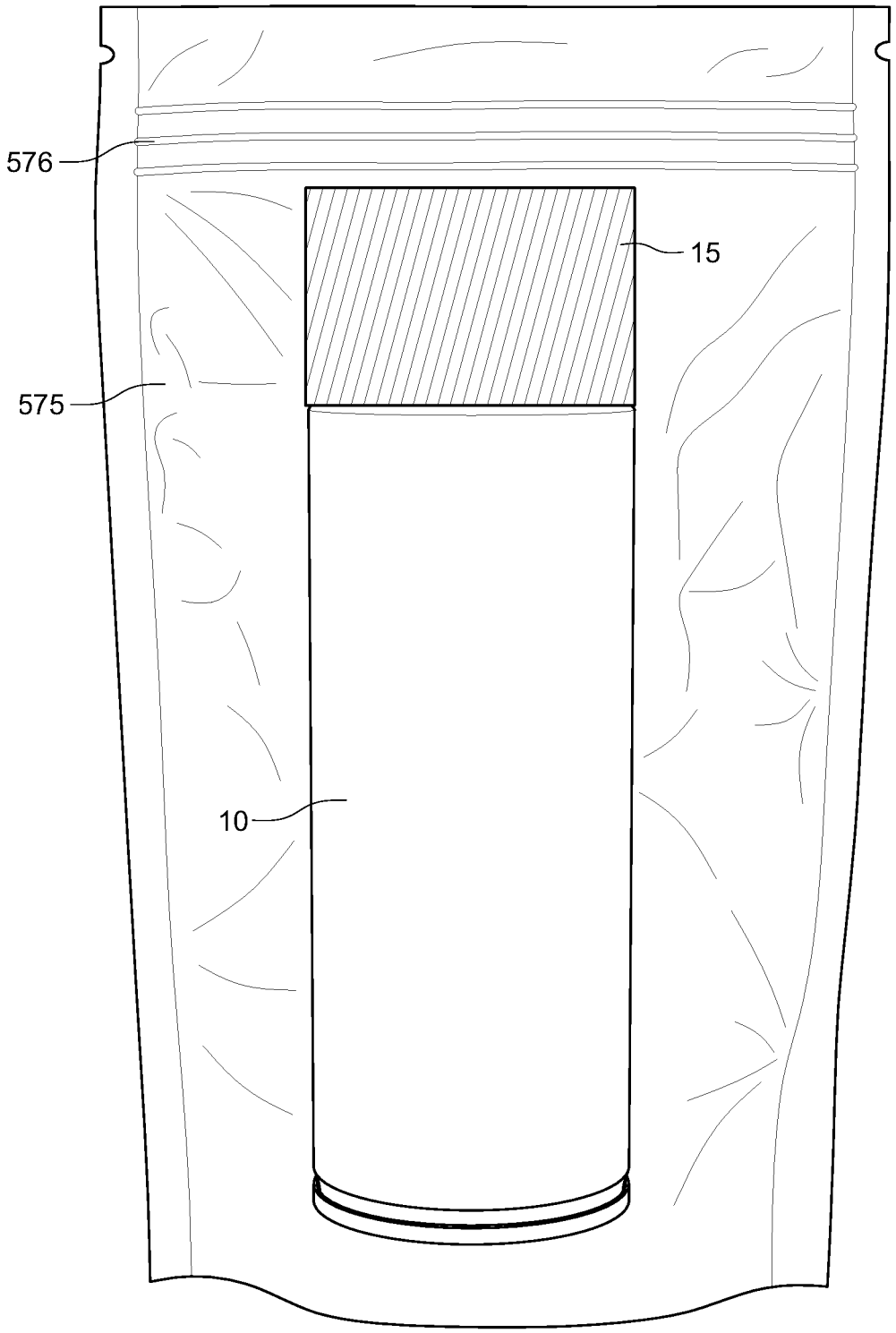

FIGS. 29*a* and 29*b* illustrate that the closure assembly can comprise a lock feature configured as a protective bag. The term "bag" refers broadly to any sealed structure, whether flexible (such as a plastic bag) or rigid (such as a rigid box). FIG. 29*a* illustrates one embodiment wherein a portion of container 10 is housed within bag 575. As illustrated, nozzle 75, container tapered wall 45, and/or sealed skirt 20 can be housed within the bag. Thus, the bag can occupy at least a portion of the cap interior. Optionally, bag 575 can include one or more opening features 576, such as a slider, zipper, pull tab, and the like to assist opening and/or reclosing. However, the presently disclosed subject matter also includes embodiments without such opening features, such that a user must use scissors or another implement to pierce the bag to remove. In use, a user must remove cap 15, and open or remove bag 575 to access nozzle 75. After a desired amount of container contents have been dispensed, the bag can be resealed or discarded, and cap 15 repositioned over the nozzle. FIG. 29*b* illustrates one embodiment wherein the entire container is housed within bag 575. To access nozzle 75, the bag must either be opened or removed. After a desired amount of container contents have been dispensed, the container is resealed within the bag, or the bag can be discarded.

Figure 30:
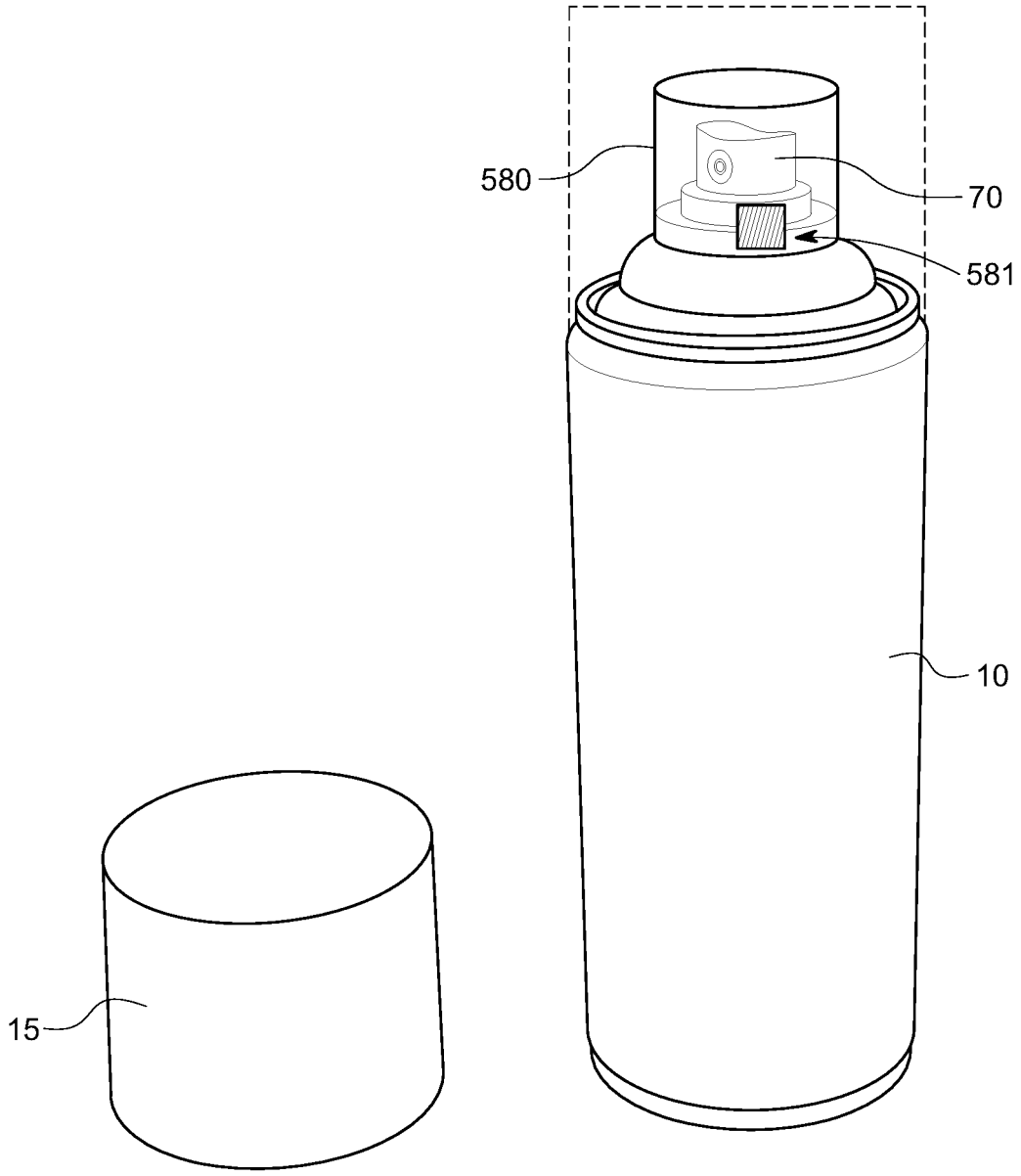
FIG. 30 is a perspective view illustrating a closure assembly configured as an inner cap in accordance with some embodiments of the presently disclosed subject matter.

FIG. 30 illustrates one embodiment of a closure mechanism embodied as inner cap 580, positioned within cap interior 130. The inner cap can be sized and shaped to house actuator 70, first joint 50, second joint 51, or any portion of tapered wall 40. The inner cap can releasably attach to the container using any known method, such as a snap-fit closure, adhesive, and the like. In some embodiments, inner cap 580 can include opening 581 that can be used for removal of the inner cap. For example, a tool (e.g., screwdriver) can be inserted into opening 581 to detach the inner cap from the container.

Figure 31A:
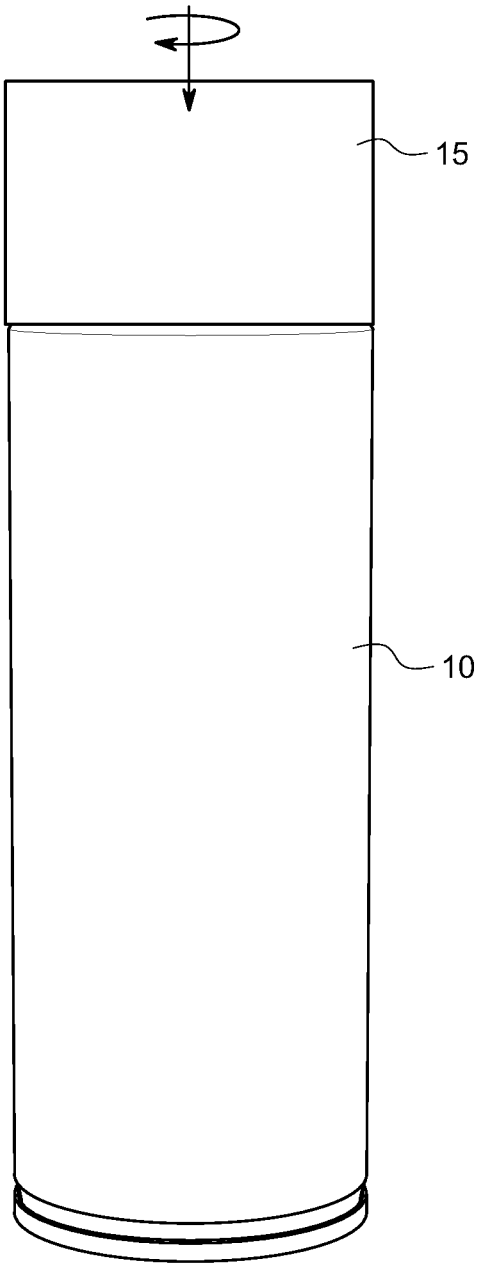
FIG. 31*a* is a front plan view illustrating a closure assembly comprising a cap with a push down lock in accordance with some embodiments of the presently disclosed subject matter.
Figure 31B:
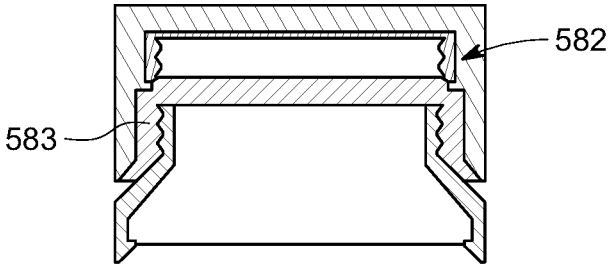
FIG. 31*b* is a cutaway view of the cap of FIG. 31*a*.
Figure 31C:
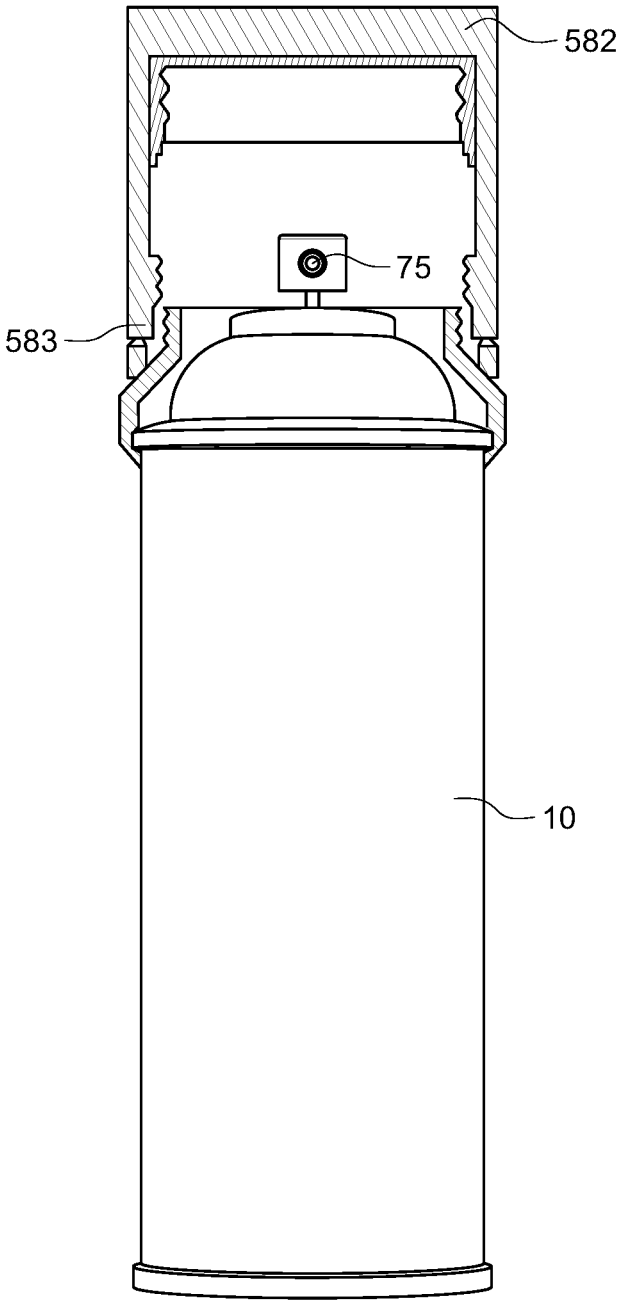
FIG. 31*c* is a side plan view of the closure assembly of FIG. 31*a*.

FIGS. 31*a*-31*c* illustrates one embodiment of a closure mechanism comprising cap 15 configured with a push down lock. Particularly, the cap can include one or more features that allow a user to push down on the top portion of the cap while simultaneously twisting the cap to remove it. For example, the lid can include an inner sealing cap and an outer cap to push inside the container. In some embodiments, outer cap 582 can spin freely on inner cap 583 until pressure is applied to the top of the outer cap. Once pressure is applied the inner and outer caps lock together. To open the cap, a user must press and rotate the outer lid simultaneously, so that the inner lid is pushed against a lock and it opens. The threads on inner cap 583 can then thread off the threaded ring that is held rigid to the container. The cap is considered child proof in the sense that a user must "push down" or squeeze and turn the cap to unlock and open the cap to allow nozzle 75 to be accessed. It should be appreciated that cap 15 is not limited and can include any design or configuration that allows a "press and turn" removal.

Figure 32A:
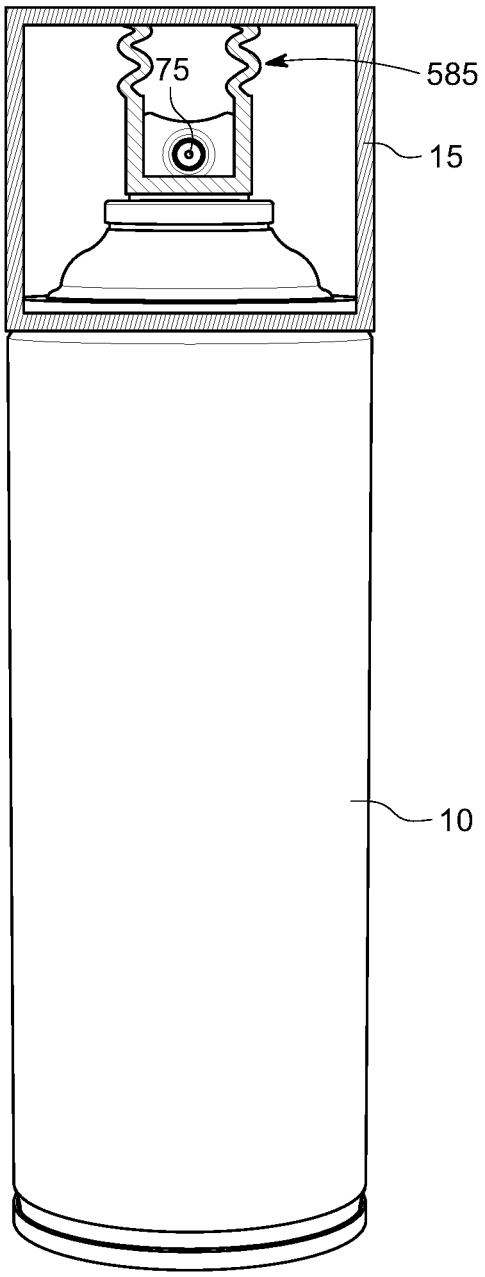
FIGS. 32*a* and 32*b* illustrate a closure assembly comprising a nozzle encapsulated with an elastomeric material in accordance with some embodiments of the presently disclosed subject matter.
Figure 32B:
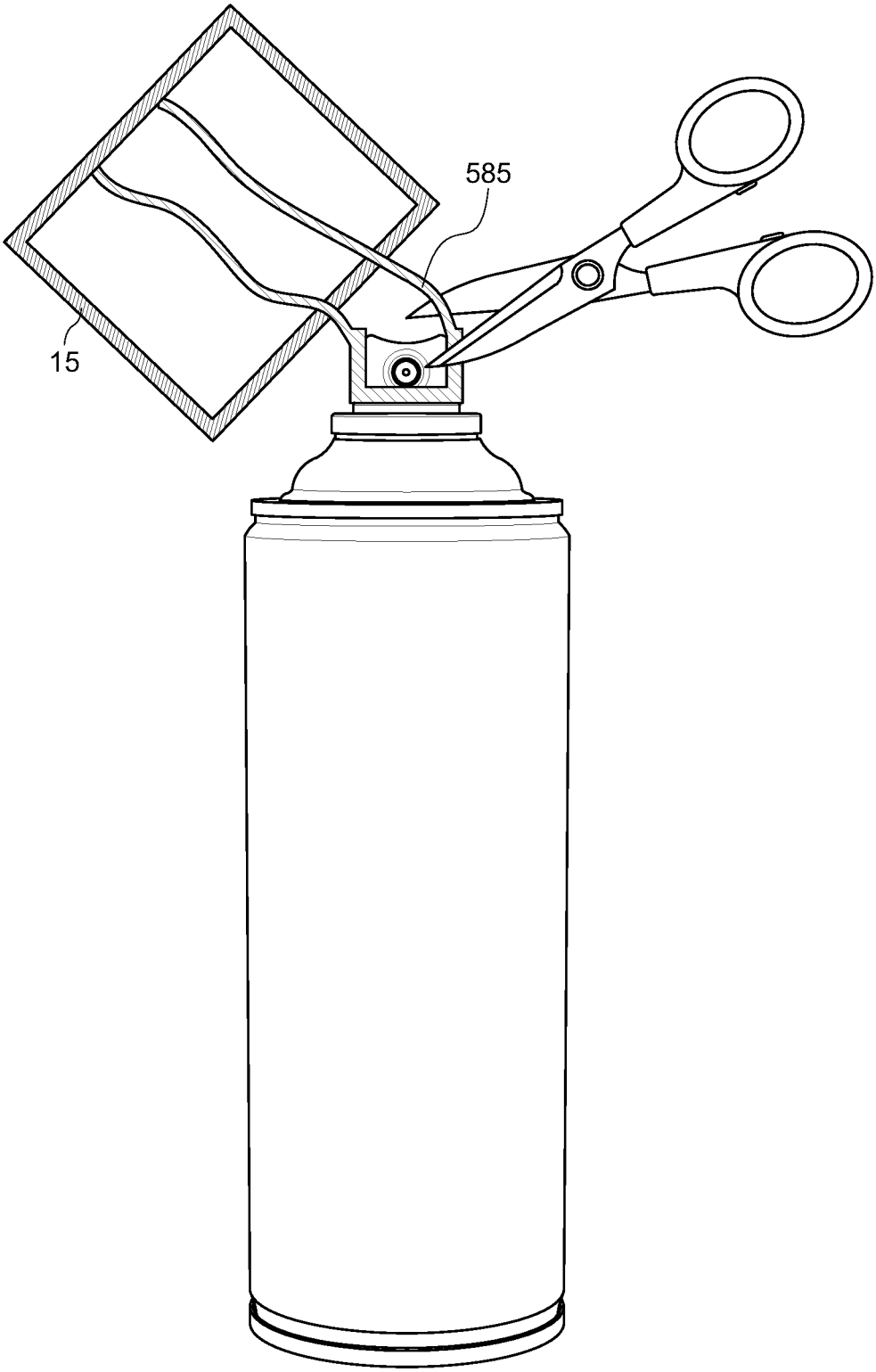

FIGS. 32*a* and 32*b* illustrate one embodiment of a closure medium wherein nozzle 75 is connected or at least partially encapsulated with an elastomeric material (such as rubber). The term "elastomeric" as used herein refers to materials that extend in at least one direction when a force is applied. As shown, elastomeric material 585 is wrapped at least partially around nozzle 75 and attached to at least one surface of cap 15 (e.g., top surface 120). Any known method can be used to attach elastomeric material 585 to the cap and/or nozzle, such as (but not limited to) wrapping, adhesive, melting, and the like. In use, when cap 15 is removed from container 10, elastomeric material 585 is stretched to a certain point. If the elastomeric material is not cut (e.g., such as through the use of scissors), nozzle 75 is pulled from the container, rendering the container unusable. As shown in FIG. 32*b*, if the user cuts elastomeric material 585 prior to reaching the stretch limit of the material, the cap can easily be removed, leaving the nozzle intact for use. After a desired amount of material is dispensed, the cap can be replaced.

Figure 33:
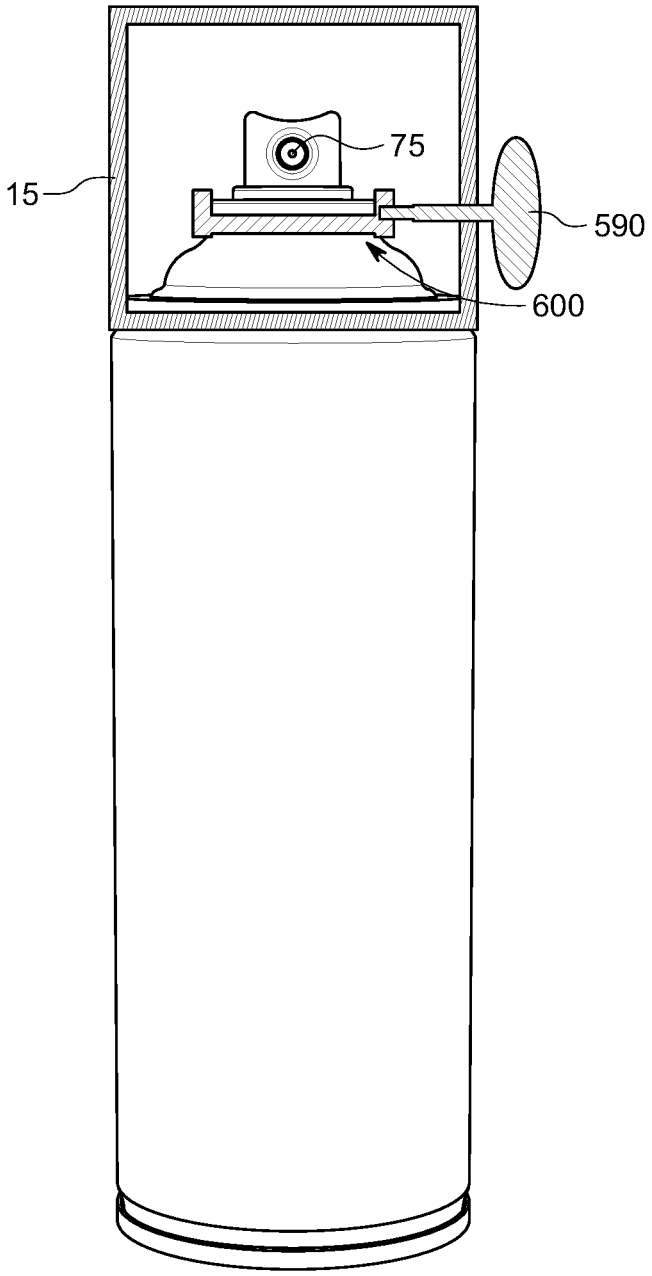
FIG. 33 is a front plan view of a closure assembly comprising a twist knob in accordance with some embodiments of the presently disclosed subject matter.

FIG. 33 illustrates one embodiment of a closure medium comprising a lock feature. Particularly, the lock feature includes knob 590 that extends through one face of cap 15 and attaches to center piece 600 that encircles a portion of the container housed within the cap interior. For example, in some embodiments, the nozzle, actuator, first joint, or second joint can be encircled by center piece 600. To access nozzle 75 by removing cap 15, a user must twist knob 590 in one direction to rupture tab 595 to unlock the cap. Prior to rupturing tab 595, the cap is locked in position due to the connection to the center piece. After the tab is broken, the cap can be removed, and the contents dispensed from nozzle 75. Center piece 600 can be constructed from one or more durable materials (e.g., plastic, metal, and the like) to resist damage during torsion of knob 590.

Figure 34:
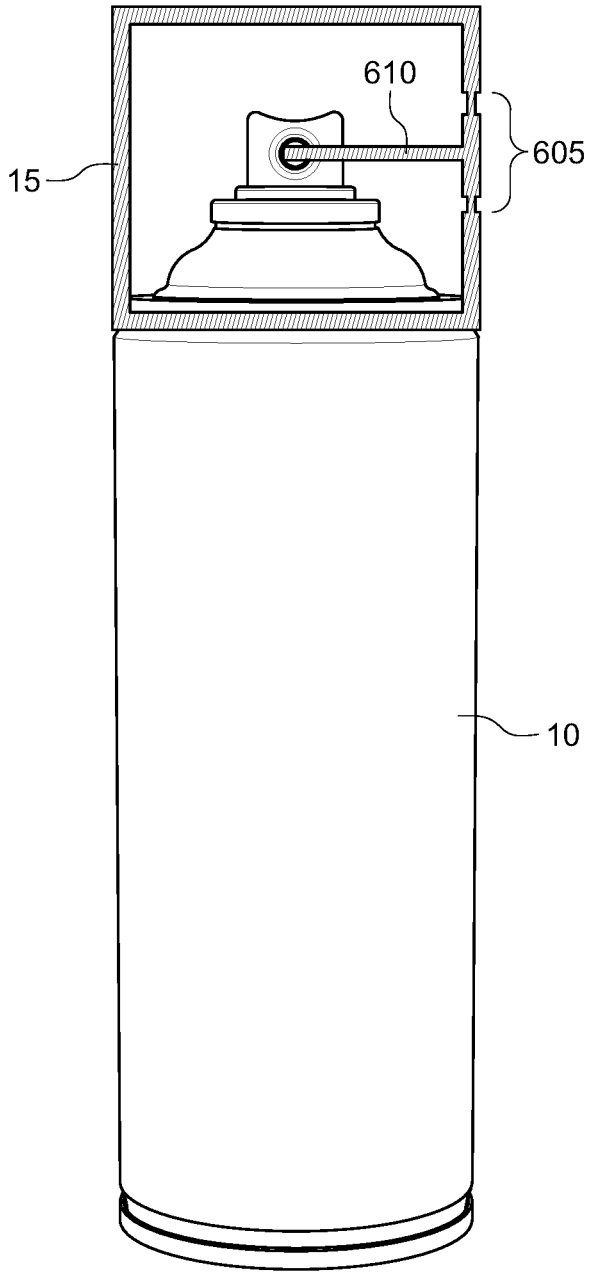
FIG. 34 is a front plan view of a closure assembly comprising a cap with a frangible opening in accordance with some embodiments of the presently disclosed subject matter.

FIG. 34 illustrates one embodiment of a closure medium comprising a lock feature. Particularly, the lock feature includes frangible opening 605 configured on a sidewall of cap 15. The frangible opening includes link 610 that extends into the interior of the cap and attaches to nozzle 75, thereby plugging the nozzle hole through which the container contents are dispensed. In use, the frangible opening can be ruptured through the use of pressure. For example, finger pressure or a sharp tool (e.g., screwdriver) can be used. After the frangible opening is ruptured, the cap can be removed from the container. The user can easily remove link 610 from the nozzle to dispense the container contents. Prior to rupture of the frangible aperture, the connection created by link 610 between the cap and the nozzle prevents the cap from being removed.

Figure 35A:
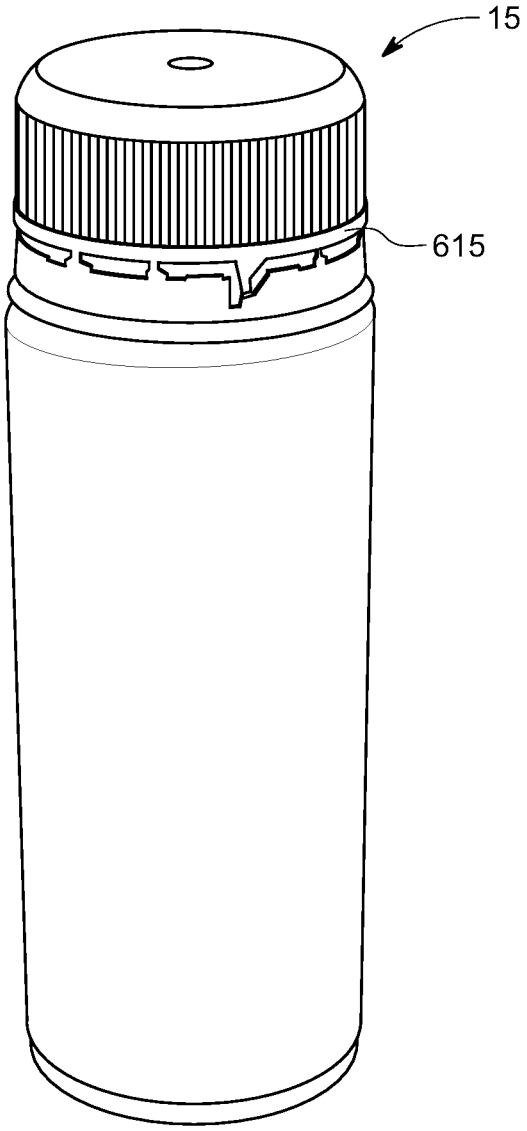
FIGS. 35*a* and 35*b* are perspective views of a closure assembly comprising a frangible seal in accordance with some embodiments of the presently disclosed subject matter.
Figure 35B:
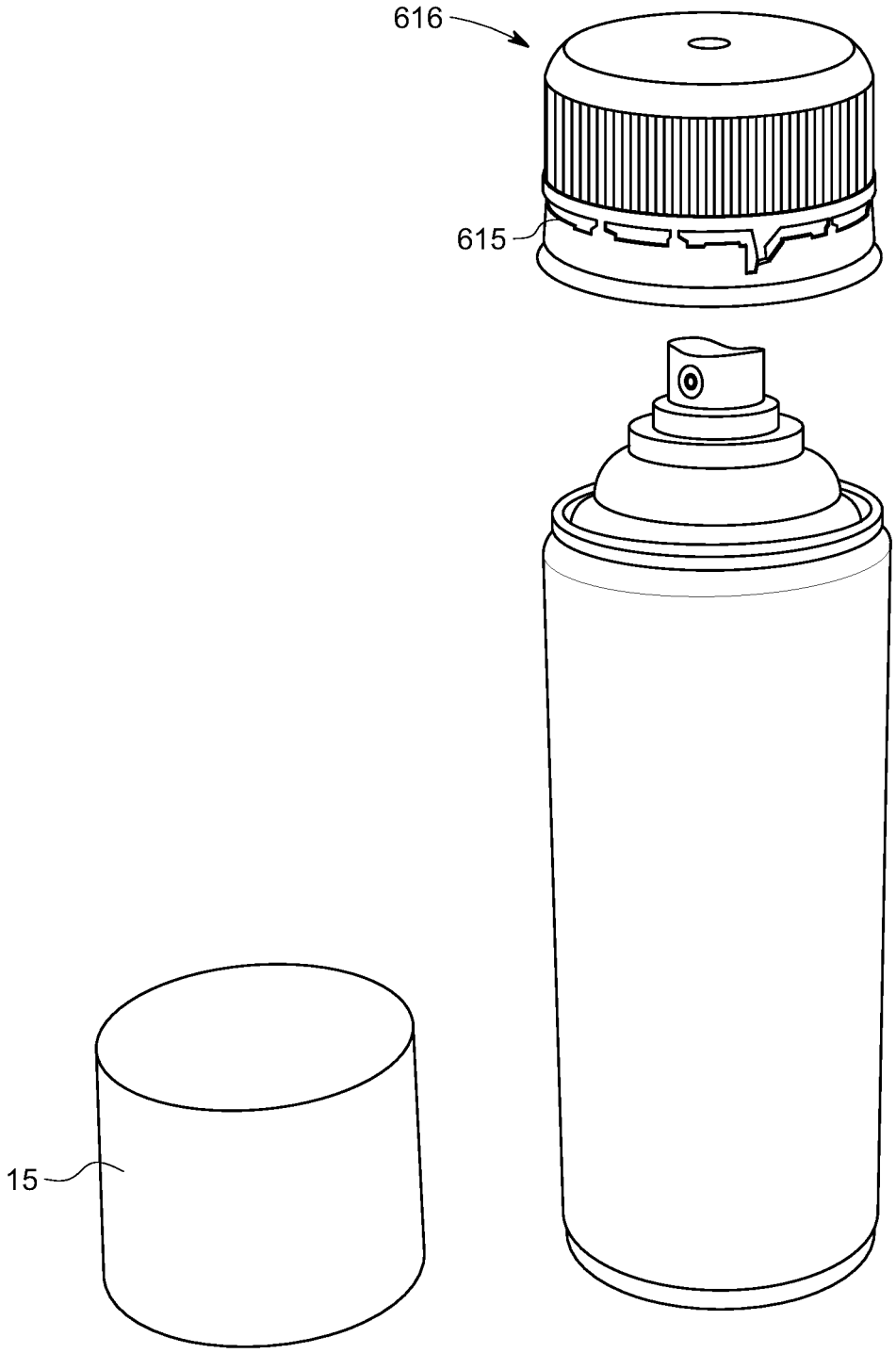

FIGS. 35*a* and 35*b* illustrate one embodiment of a closure medium comprising a lock feature. For example, as shown in FIG. 35*a*, the bottom edge of an inner or outer cap can include frangible seal 615 positioned about the cap circumference. The frangible seal can be created using any known method, such as laser scoring, mechanical weakness, and the like. The area below the frangible seal can include one or more tabs that contact the outer surface of the container to anchor the lower portion in position. The frangible seal will rupture under pressure, such as through a twisting action of the cap. In use, a user can grasp lid 15 and twist in one direction. The tabs in the lower portion of the cap anchor the lower edge of the cap in position, resulting in a rupture of frangible seal 615 as the top portion of the cap is rotated. Prior to rupture of the frangible seal, the cap tabs anchor the cap in position so that it cannot be removed. In some embodiments, the frangible seal can be positioned on inner cap 616 that is located within in the interior of cap 15 when positioned on container 10. In other embodiments, the frangible seal can be positioned directly in cap 15.

Figure 36:
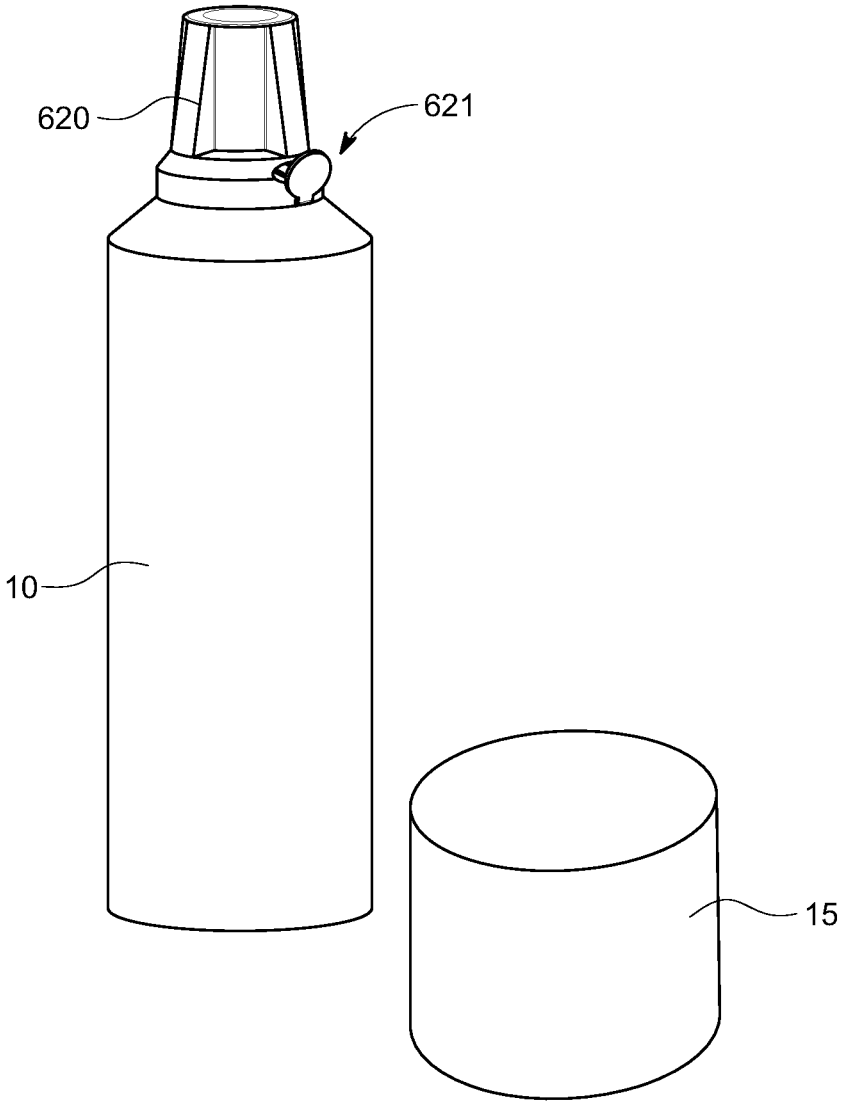
FIG. 36 is a perspective view of a closure assembly configured with a peel tab in accordance with some embodiments of the presently disclosed subject matter.

As shown in FIG. 36, in some embodiments the closure assembly can include inner cap 620 comprising peel tab 621. The term "peel tab" refers to a tab that extends at least partially around an element and includes a perforated or frangible connection with the element that can be removed, e.g., with a peeling action. For example, the inner cap includes a peel tab configured in the lower cap edge. The cap covers nozzle 75, preventing access thereto. To access the nozzle, peel tab 620 must be removed. In some embodiments, the peel tab includes a grip that provides a starting point for the user to grasp and pull. The user grasps the grip and pulls around the circumference of the inner cap edge. The lower portion of the cap edge is removed, and connection to the container is broken. As a result, the inner cap can be completely removed and discarded. After a desired amount of the container contents have been removed, cap 15 can be repositioned on the container.

Figure 37A:
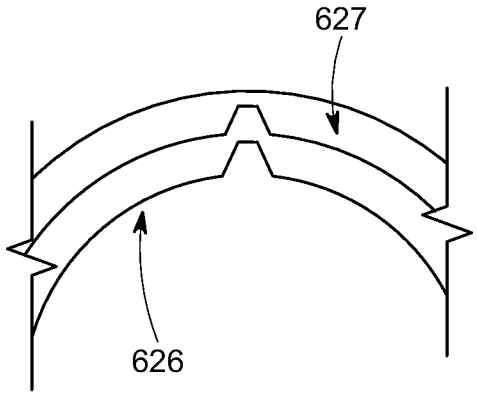
FIGS. 37*a*-37*c* are perspective views illustrating a closure assembly comprising a layered unlock feature in accordance with some embodiments of the presently disclosed subject matter.
Figure 37B:
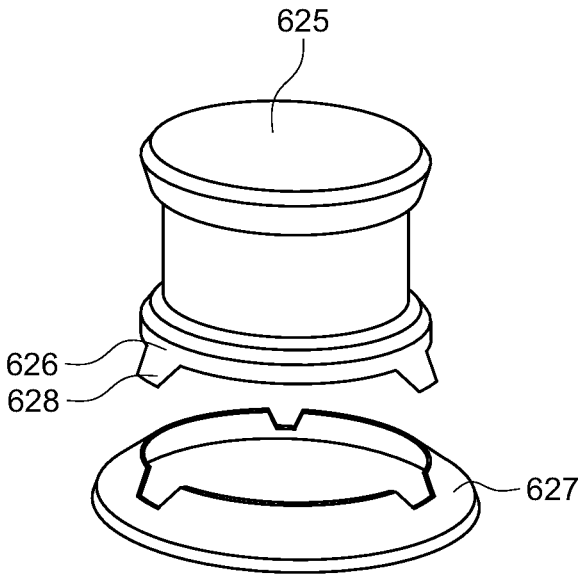
Figure 37C:
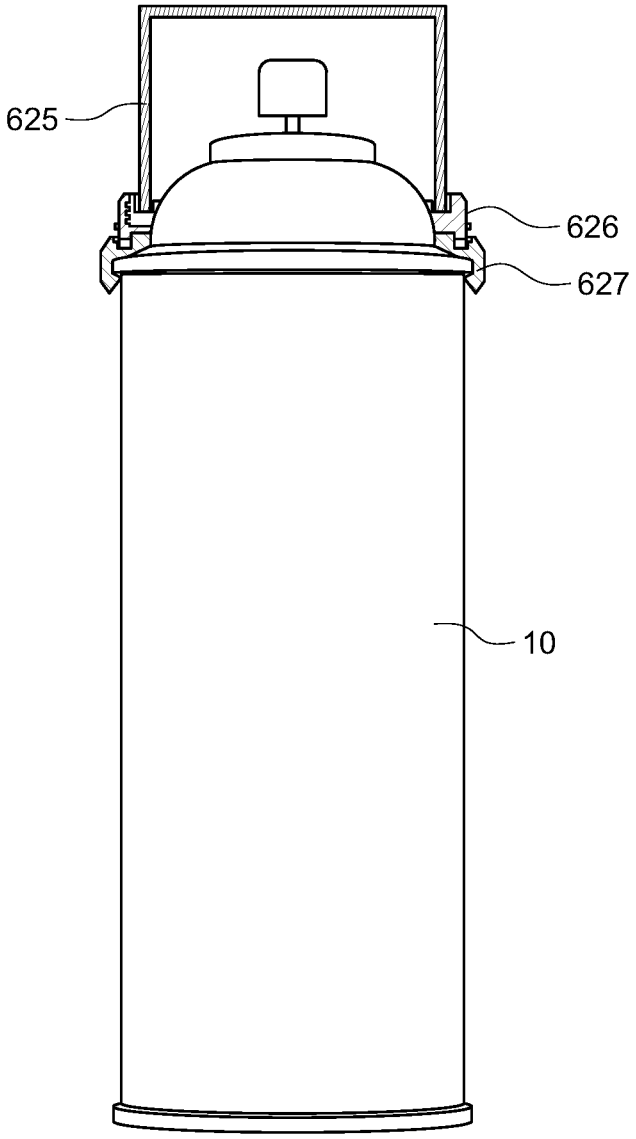

FIGS. 37*a*-37*c* illustrate one embodiment of a closure assembly that includes a layered unlock feature. For example, cap 15 can be configured to include main body 625 and inner and outer rings 626, 627 configured at the lower ends of the cap. Main body 625 is configured to house nozzle 75 within the cap interior. The inner and outer rings each rotate relative to each other. The rings include one or more notches 628 that must align to release cap 15 from the container. Thus, when the inner and outer rings are not aligned (e.g., notches are not aligned), main body 625 cannot be removed and a user cannot access nozzle 75.

The disclosed closure assembly therefore provides many benefits over prior art containers. For example, current containers (such as spray paint cans or chemical containers) lack safety features to prevent premature opening of the containers, such as in-store or by children. As a result, dangerous and/or viscous chemicals can be dispensed and potentially harm users or property. Further, prior art containers can be difficult to open outside of the retail environment (e.g., at home). Particularly, consumers often have difficult opening prior art containers after they are purchased. Even if the consumer is able to open the container to access the dispensing mechanism without breaking the cap, the consumer has the same difficulty each time the container is opened and closed (e.g., difficulty removing and/or reapplying the cap).

As discussed in detail herein above, the disclosed closure assembly advantageously provides an added safety feature, reducing the likelihood that a container will be opened in-store or by children. For example, the consumer must remove a portion or shrink wrap to remove the cap. The disclosed assembly further allows a consumer to easily remove the cap and dispense the container contents at home. Even users with joint pain or other difficulties can successfully use the disclosed assembly. Thus, the goal of the disclosed closure assembly (and associated container) is providing a safety feature in retail environments, while also allowing ease of use at home. For example, when the disclosed closure assembly is configured with a screw-on/screw-off cap, a user can easily open the container to access the container dispensing mechanism with a simple twisting motion. Even users with joint paint or other similar health issues can open and close the disclosed containers. The cap can further be easily attached and detached multiple times by the user until the container contents have been fully dispensed. The disclosed assembly therefore allows for easy open/close of the containers, as well as enables easy repeated storage and the like.

The disclosed assembly further preserves the container cap to allow repeated attachment and detachment. For example, the container cap can be easily unscrewed to dispense the container contents, and re-screwed to preserve the container contents between uses. In comparison, caps of prior art containers are commonly destroyed during the removal process, thereafter leaving the container uncovered or requiring the use of an improperly fitting/sealing cover. In this way, the disclosed assembly allows for easy opening/closing of the container, while also preserving the container contents for later dispensing applications.

Unless otherwise expressly stated, it is in no way intended that any method set forth herein be construed as requiring that its steps be performed in a specific order. Accordingly, where a method claim does not actually recite an order to be followed by its steps, or it is not otherwise specifically stated in the claims or descriptions that the steps are to be limited to a specific order, it is in no way intended that any particular order be inferred.

Many modifications and other embodiments of the embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A lock assembly operable to inhibit detachment of a cap from a corresponding container, comprising:

a lock configured to inhibit detachment of a first coupler coupled to the container and a second coupler coupled to the cap, with the first coupler being disposed about at least a portion of an exterior periphery proximate one end of the container and the second coupler being disposed about at least a portion of an interior periphery proximate an open end of the cap, the first and second couplers being operable when coupled to releasably attach the cap to the container and when decoupled to detach the cap from the container, wherein the lock further includes a protective cap having a top surface that is planar to and disposed in a top surface of the cap, with a perforated region disposed about the periphery of the top surface of the protective cap, the perforated region being configured to inhibit rotation of the cap prior to overcoming a retaining force associated with the perforated region.

2. The lock assembly of claim 1, wherein the lock further includes a tamper evident structure disposed about the cylinder and coupled to the cap, with a plurality of perforations disposed between the cap and the tamper evident structure and configured to inhibit rotation of the cap prior to removing the perforations to decouple the tamper evident structure and the cap.

3. The lock assembly of claim 1, wherein the lock further includes a tamper evident structure disposed about a junction of the cap and the container, with the tamper evident structure having a vertical perforation defining first and second ends of the tamper evident structure and having a pull tab proximate the vertical perforation, with the pull tab being configured to enable a forcible separation of the first and second ends of the tamper evident structure at the vertical perforation so that the tamper evident structure can be removed from the container and the cap, the tamper evident structure being configured to inhibit detachment of the first and second couplers prior to removal of the tamper evident structure.

4. The lock assembly of claim 1, wherein the lock includes a removable tab positioned outside a joint where the first and second couplers join, with the removable tab being operable to inhibit detachment of the first and second couplers prior to removal of the tab, the removable tab being coupled to a groove disposed in the cap, with the tab and the groove being jointly configured when coupled to inhibit detachment of the first and second couplers prior to removal of the tab from the groove.

5. The lock assembly of claim 4, wherein the removable tab includes a hinge that enables the tab to attach and detach from the groove.

6. The lock assembly of claim 1, wherein the lock further includes a plurality of bands coupled between and distributed about external peripheries of the cap and the container and operable to inhibit detachment of the first and second couplers prior to removal of at least one band, with a first end of each band being coupled to a head that is coupled about the external periphery of the cap and a second end of each band being coupled to a base that is coupled about the external periphery the container.

7. The lock assembly of claim 6, wherein at least one band includes a tab that is configured to enable a forcible rupture of that band.

8. The lock assembly of claim 6, wherein at least one band has a frangible portion associated with a tamper evident structure disposed about an external periphery of the cap or the container and having a pull tab configured to enable a forcible separation of the frangible portion of each band, the tamper evident structure being operable to inhibit detachment of the plurality of bands prior to removal of the tamper evident structure.

9. The lock assembly of claim 8, wherein the tamper evident structure includes a vertical perforation defining first and second ends of the tamper evident structure, with the pull tab being proximate the vertical perforation.

10. The lock assembly of claim 1, wherein the lock further includes a tamper evident structure having a plurality of non-continuous sections releasably coupled between the cap and the container, with the tamper evident structure being operable to inhibit detachment of the first and second couplers prior to removal of at least one of the non-continuous sections.

11. The lock assembly of claim 1, further comprising:

a third coupler coupled to the container and a fourth coupler coupled to an outer cap, with the third coupler being disposed about at least a portion of the exterior periphery proximate the one end of the container and the fourth coupler being disposed about at least a portion of an interior periphery proximate an open end of the outer cap, the third and fourth couplers being operable when coupled to releasably attach the outer cap to the container and when decoupled to detach the outer cap from the container to enable access to the cap, with the cap having an aperture disposed in a side-wall of the cap so as to enable access by a tool configured to forcefully decouple the container and cap.

12. The lock assembly of claim 11, wherein the first and second couplers are associated with a snap-fit closure mechanism and the third and fourth couplers are associated with helical threads.

13. The lock assembly of claim 1, wherein each of the first and second couplers include a threaded ring and the lock further includes the cap disposed in an outer cap, with the outer cap and cap being jointly configured as a push down lock that is operable to forcefully engage and rotate the threaded rings so as to enable detachment of the the first and second couplers.

14. The lock assembly of claim 1, wherein the lock includes a plurality of removable tabs or a perforated joint disposed between the cap and the container and positioned outside a joint where the first and second couplers join, with the plurality of removable tabs or the perforated joint being configured to inhibit removal of the cap from the container prior to removing the plurality of removable tabs or the perforated joint.

15. The lock assembly of claim 1, wherein the lock includes a tamper evident structure having a pull tab and a perforated joint coupled between the tamper evident structure and the cap, with the tamper evident structure being positioned at or about a joint where the first and second couplers join, with the pull tab being configured to enable a forcible separation of the perforated joint so that the tamper evident structure can be removed from the cap, the tamper evident structure being configured to inhibit detachment of the first and second couplers prior to the tamper evident structure being removed from the cap.

16. The lock assembly of claim 15, wherein the tamper evident structure includes a vertical perforation defining first and second ends of the tamper evident structure, with the pull tab being proximate the vertical perforation.

* * * * *